US005673711A

United States Patent [19]

Andrews

[11] Patent Number: 5,673,711

[45] **Date of Patent: *Oct. 7, 1997**

[54] FINGERTIP CONTROL MUSTACHE SHAVING DEVICE

[76] Inventor: Edward A. Andrews, 6835 Beach Rd., Troy, Mich. 48098

[ * ] Notice: The term of this patent shall not extend beyond the expiration date of Pat. No. 5,479,950.

[21] Appl. No.: 515,832

[22] Filed: Aug. 16, 1995

Related U.S. Application Data

[63] Continuation-in-part of Ser. No. 30,949, Oct. 6, 1994, Pat. No. 5,479,950, which is a continuation of Ser. No. 20,586, Feb. 22, 1993, abandoned.

[51] Int. Cl.[6] ..... A45D 2/50

[52] U.S. Cl. ..... 152/215; 132/214; 132/148; 132/289; 30/30

[58] Field of Search ..... 132/215, 214, 132/148, 289; 30/30, 32, 48, 49, 55, 58, 76, 84, 85

[56] References Cited

U.S. PATENT DOCUMENTS

| | | |
|---|---|---|
| D. 159,994 | 9/1950 | Lee . |
| D. 197,588 | 2/1964 | Macon . |
| 778,388 | 12/1904 | Warren . |
| 839,447 | 12/1906 | Arnold . |
| 1,217,288 | 2/1917 | Donnelly . |
| 1,643,757 | 9/1927 | Wallenbeck . |
| 1,969,100 | 8/1934 | Segal . |
| 1,976,290 | 10/1934 | Motley . |
| 2,568,368 | 9/1951 | Sayer et al. . |
| 2,569,344 | 9/1951 | Shaeffer . |
| 2,575,652 | 11/1951 | Bovee . |
| 2,633,635 | 4/1953 | North . |
| 2,858,835 | 11/1958 | Parziale . |
| 2,866,984 | 1/1959 | Plough . |
| 2,972,187 | 2/1961 | Gore . |
| 3,238,616 | 3/1966 | Eweson . |
| 3,299,507 | 1/1967 | Mistretta . |
| 3,488,764 | 1/1970 | Welsh . |
| 3,536,080 | 10/1970 | Player . |
| 3,557,448 | 1/1971 | Shead . |
| 3,613,233 | 10/1971 | Lundell . |
| 3,621,569 | 11/1971 | Morris . |
| 3,805,381 | 4/1974 | Broussard, Sr. . |
| 4,029,112 | 6/1977 | Boose . |
| 4,319,399 | 3/1982 | Ciafffone . |
| 4,344,226 | 8/1982 | Blake, III . |

(List continued on next page.)

FOREIGN PATENT DOCUMENTS

| | | |
|---|---|---|
| 2311634 | 1/1977 | France . |
| 802750 | 10/1958 | United Kingdom . |

*Primary Examiner*—Gene Mancene
*Assistant Examiner*—Pedro Philogene
*Attorney, Agent, or Firm*—Harness, Dickey & Pierce, P.L.C.

[57] ABSTRACT

Several small-size mustache shaving devices, each grippable between a user's forefinger and thumb, for enabling the user to precisely shave and edge his own mustache to a desired shape, and related trimming accessories, are disclosed. Each device is lightweight and has as an elongated narrow body having a forward head portion and an integral offset rear fingertip grip portion. Each device has a small elongated razor blade strip mounted upon the head portion. The blade's razor sharp edge, which in some designs is straight and in other designs is curved, extends laterally outwardly from the head portion. The razor-sharp blade edge of the device is placed by the user against his skin adjacent the periphery of the desired mustache line and then, through fingertip movement, shaves and shapes the hairs of the user's mustache. The several embodiments of the shaving device include guarded, blunted and assembled blade designs, all-metal designs, and designs featuring a symmetrical appearance. An optional removable cover fits over the head portion and encases the blade sharp edge and is frictionally held upon the head portion for manual removal and replacement. An optional removable trimming cage fits over the head portion for enabling a user to trim his mustache hairs to any one of several chosen lengths.

56 Claims, 16 Drawing Sheets

U.S. PATENT DOCUMENTS

| | | | |
|---|---|---|---|
| 4,441,252 | 4/1984 | Caves . | |
| 4,514,903 | 5/1985 | Pope | 30/32 |
| 4,622,742 | 11/1986 | Lee . | |
| 4,663,841 | 5/1987 | Custer | 30/30 |
| 4,709,475 | 12/1987 | Phung . | |
| 4,782,590 | 11/1988 | Pope | 30/30 |
| 4,888,868 | 12/1989 | Pritchard . | |
| 4,928,716 | 5/1990 | Greene | 30/30 |
| 5,009,003 | 4/1991 | Grange . | |
| 5,220,728 | 6/1993 | Ueno et al. | 30/30 |

FIG-4
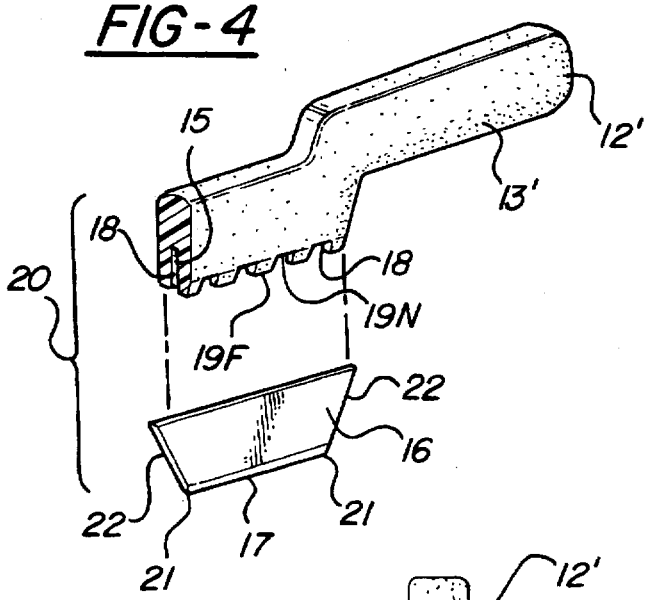
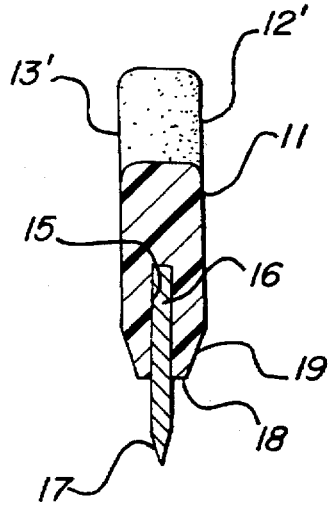
FIG-5
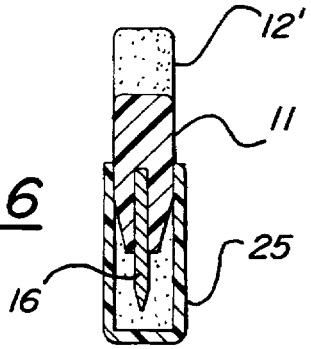
FIG-6
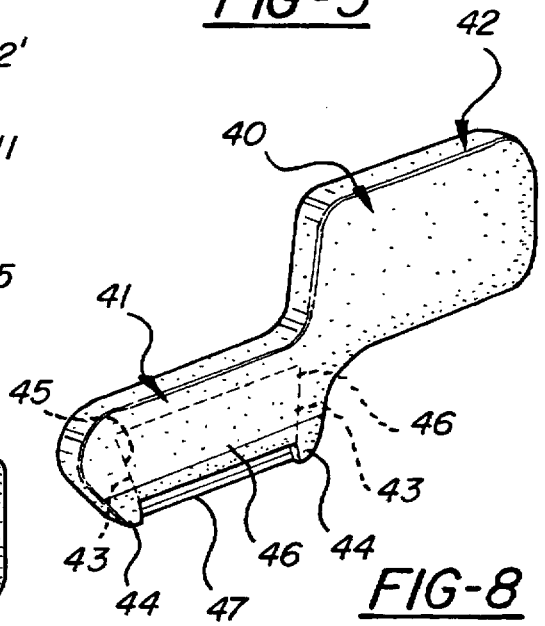
FIG-8
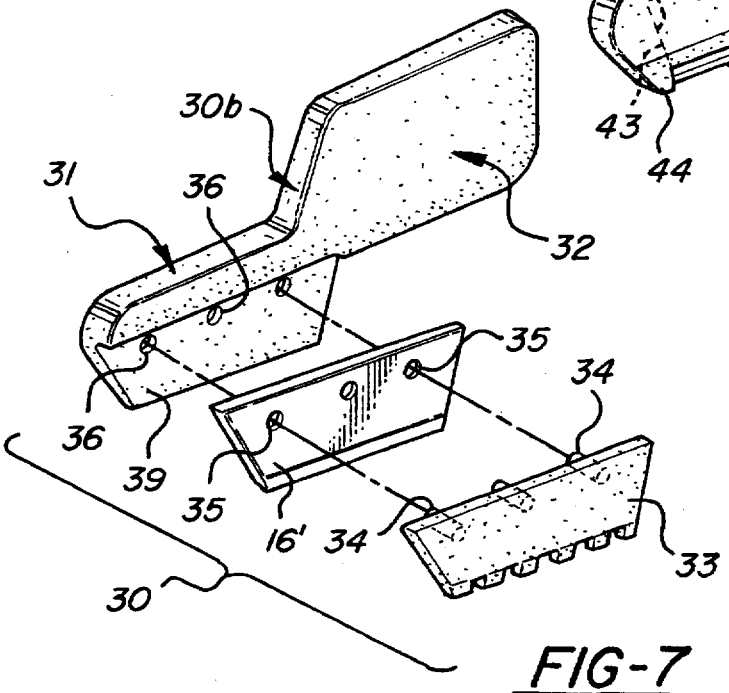
FIG-7

90
94
91
95
94
93
92
98
97
99
96

93
96

92
94
109
96
90'
91
96
92
109

102
100
101
105
108
107
106
130
148
147
136
142
135
137
146
144
141
143
140
145

A-2
112
110
111
A-1'
A-0
104
103
116
118
117
119

150
152
151
153
155
154
157
158
156
159

138
140
135
143
145
137
136
141
130
138
139

152
150
156
151

158
154

160
162
161
168
163
165
167
169

150
151

156

162

160

161
162
166
160

23B
170
172

171
173
174
176
177
178
23B 172
179
179
178

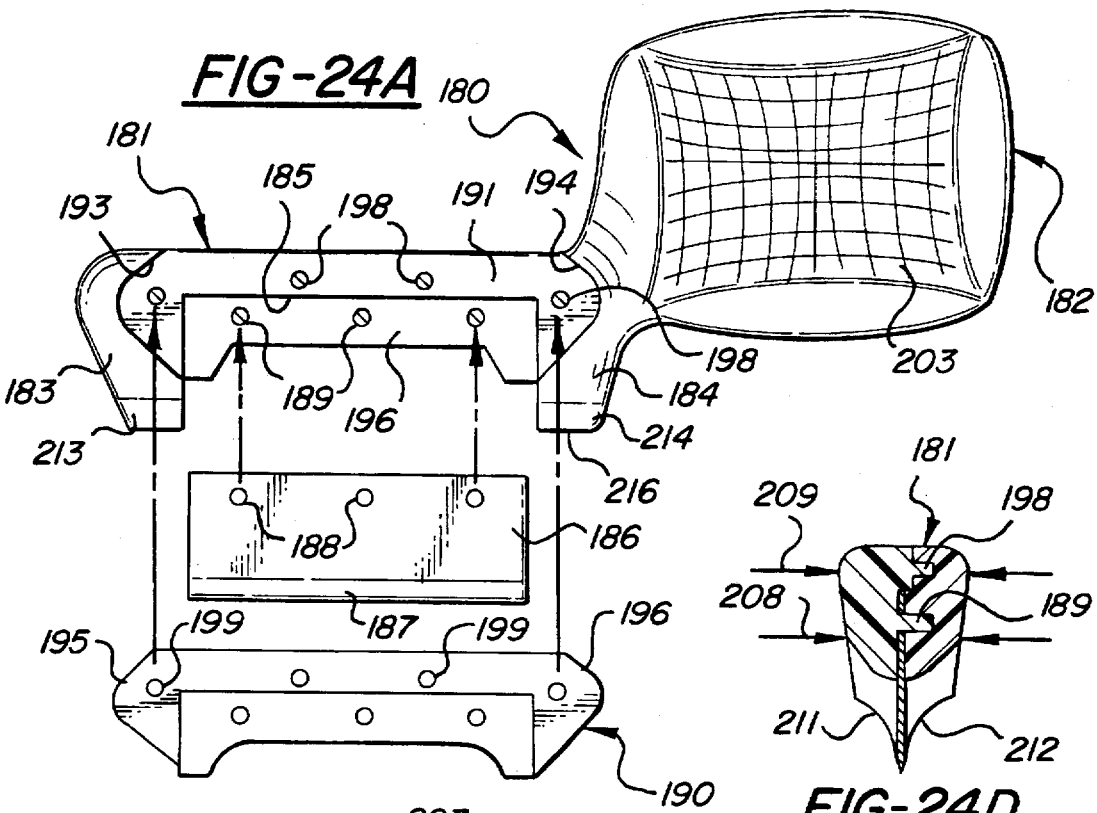
FIG-24A
FIG-24D
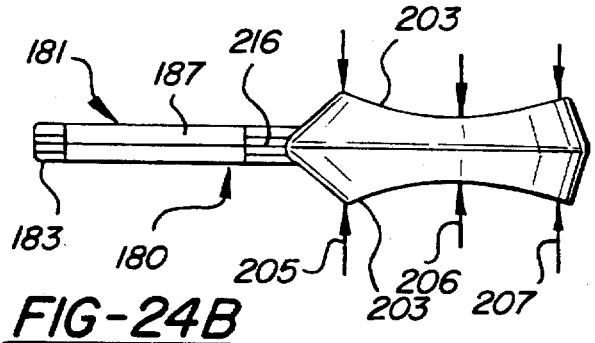
FIG-24B
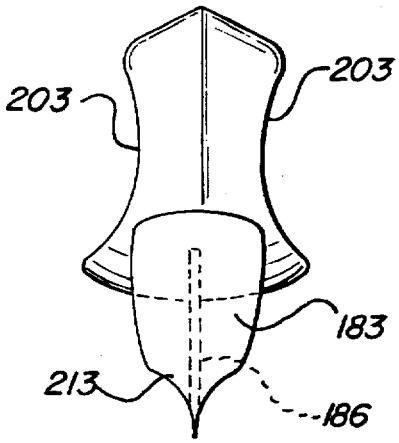
FIG-24E
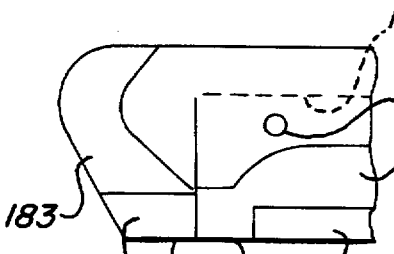
FIG-24C
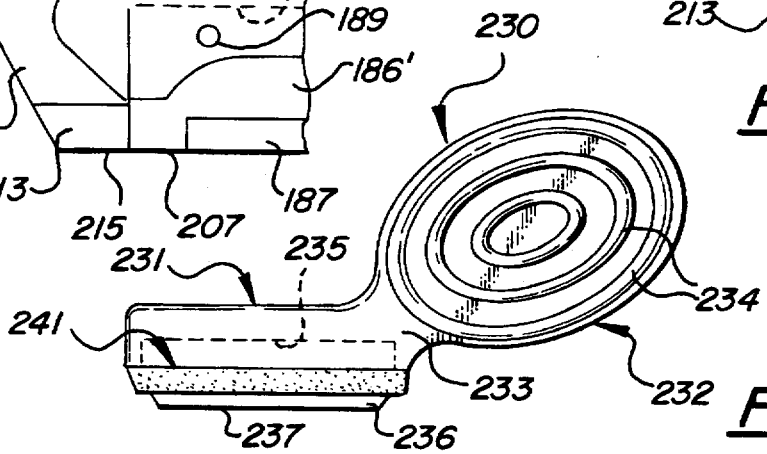
FIG-25A FIG-35A
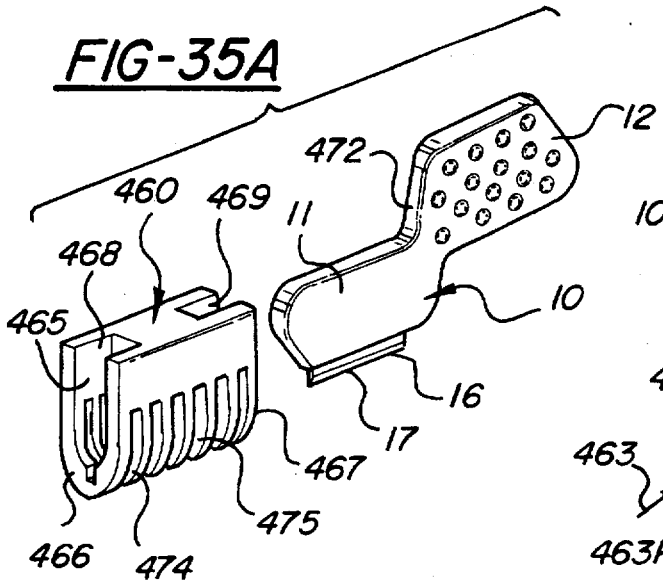
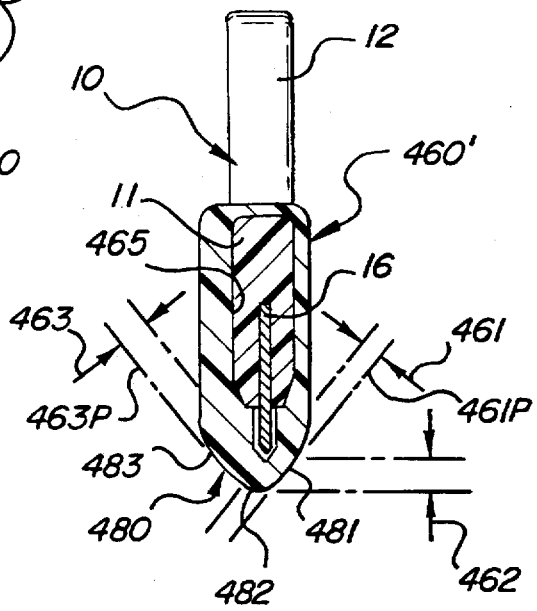
FIG-35B
FIG-36A
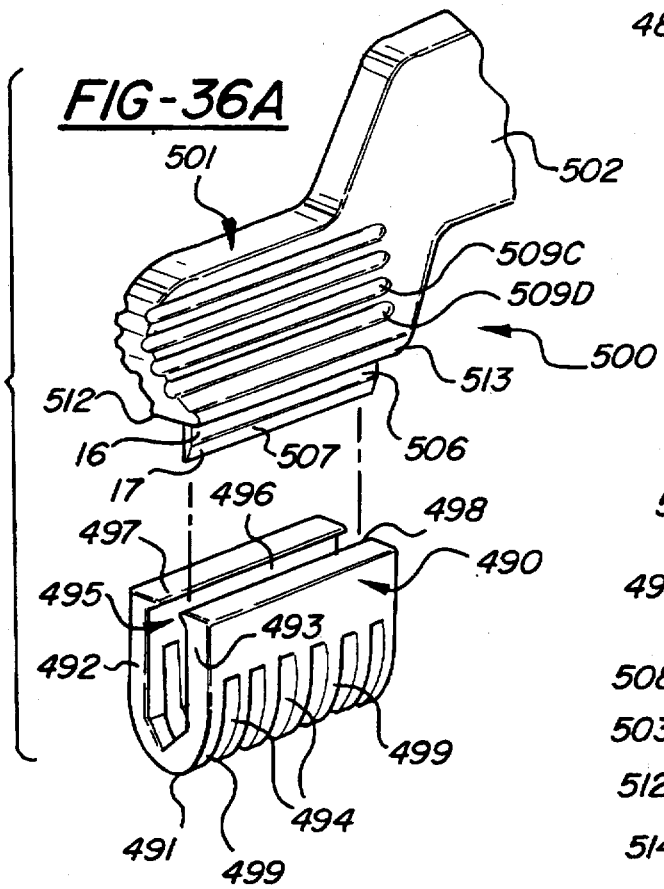
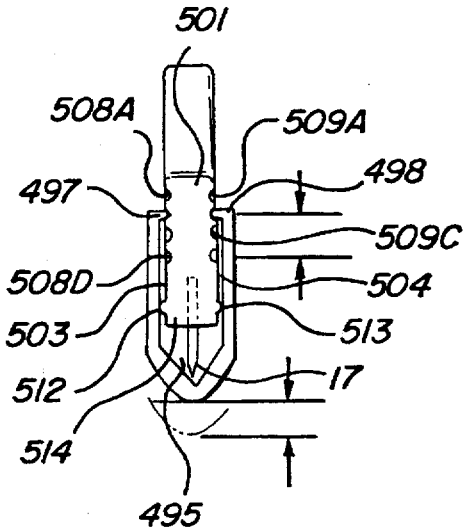
FIG-36B 530
12
11
10
534
17
535
16

530
540
12
11
503
537
538
534
17
535
16
37B 542
530
543
537
536
37B
612P
602
612P
530
12
11
600
608
606

604
600
610
612H
612H
612P
602
604
611
608
606

610
604
612H

FIG-39A
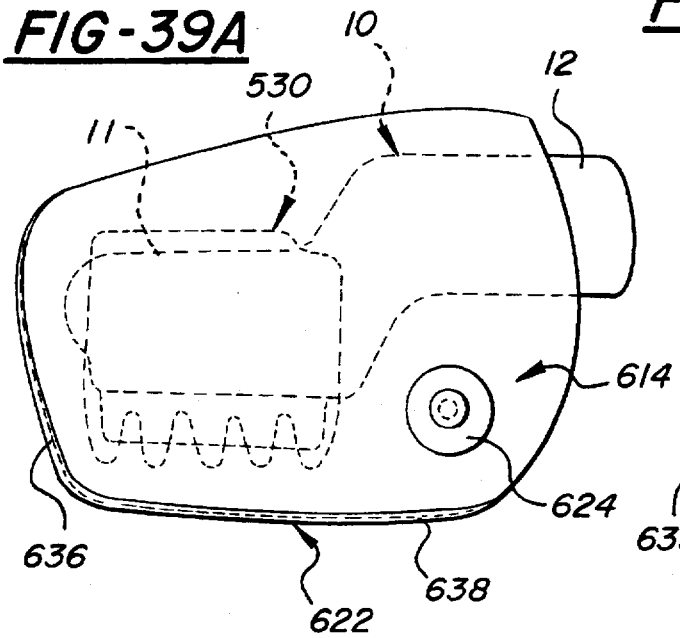
FIG-39B
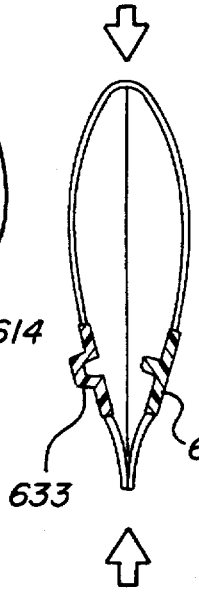
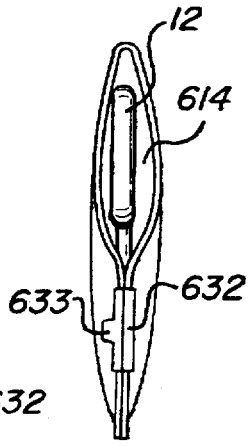
FIG-39C
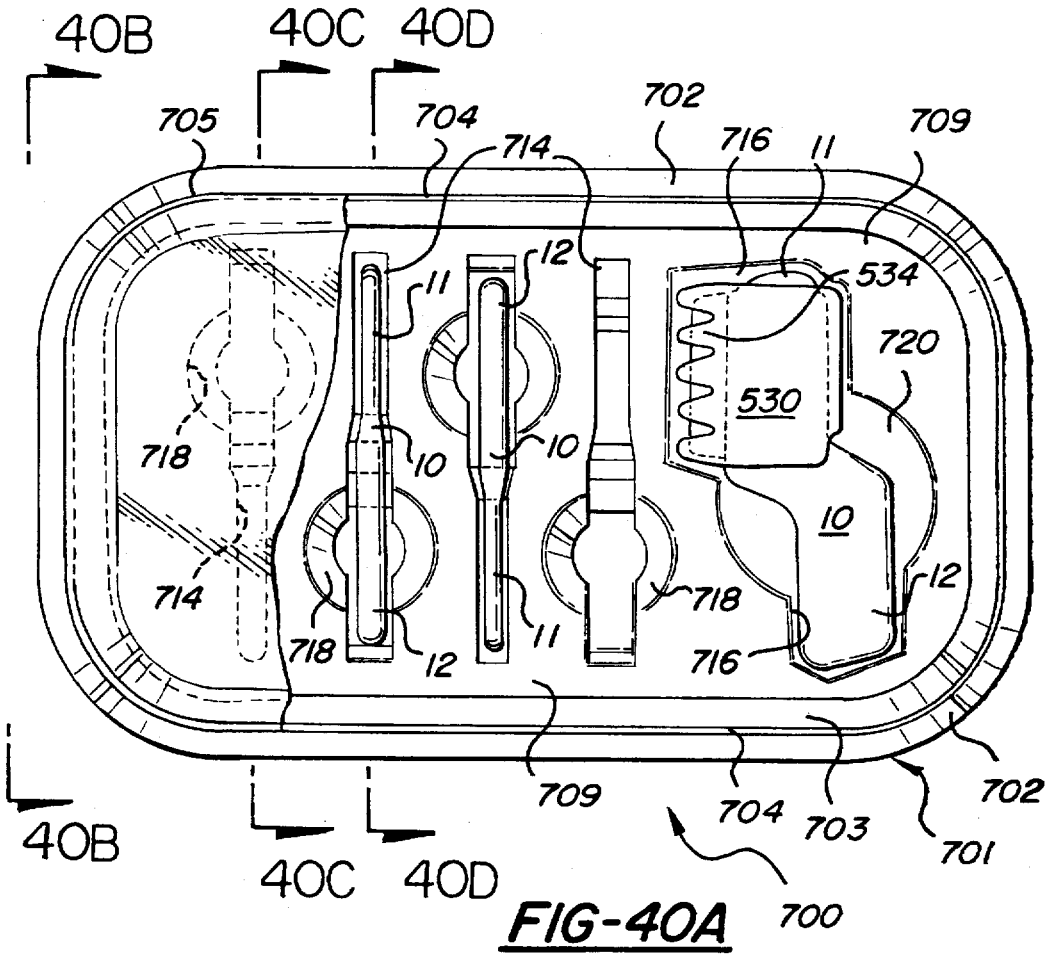
FIG-40A

FINGERTIP CONTROL MUSTACHE SHAVING DEVICE

CROSS-REFERENCE TO RELATED APPLICATIONS

This application is a continuation-in-part of application Ser. No. 08/319,149 filed Oct. 6, 1994 now U.S. Pat. No. 5,479,950 issued Jan. 2, 1996. and entitled "Fingertip Mustache Shaving Device With Cover," which is a continuation of application Ser. No. 08/020,586 filed Feb. 22, 1993 entitled "Mustache Shaving Device With Cover", now abandoned.

BACKGROUND OF THE INVENTION

1. Field of the Invention

This invention relates in general to manual mustache shaving devices, and in particular to small, lightweight manual mustache shaving devices having a razor-sharp cutting edge and a fingertip grip which can easily be gripped between and controlled by a user's fingertips for precise mustache cutting and shaving.

2. Discussion

It is a common practice to trim the hair forming a mustache with scissors or with an electric mustache trimmer device. However, it is difficult to shape the upper and lower peripheral edges of a mustache with either a scissors or an electric trimmer. The devices currently available are usually large and cumbersome, and tend to block the view of the mustache edge, thereby making a clean straight cut difficult. The typical shaver or trimmer currently available is gripped in a manner which requires manipulation of the wrist and/or arm in order to effect movement of the device, thus, making meticulous trimming of the mustache inherently difficult. Further, many of these devices are relatively complex and expensive. Even for those mustache trimming devices which are simple and/or do not obscure the field of view, it is very difficult to cut a clean straight line along the periphery of the mustache.

Thus, there has been a need for some simple, inexpensive, light-weight device for enabling an individual to easily and accurately shape his own mustache or sideburns by manipulating the device between the forefinger and thumb, and to do so even when the hair is wet and lathered. In addition, it would be desirable to have an instrument which is sufficiently inexpensive so that it may be discarded and replaced when the blade becomes inefficient (i.e., dull). This would enable the user to always have a device with a sharp razor edge whenever it is used, thereby providing optimum cutting and trimming performance.

A number of devices have been designed to shave the face or trim the mustache. Representative U.S. patents include the following: U.S. Pat. No. 778,388 to Warren teaches a razor device with a handle for shaving the face. This disclosure teaches a device for holding a standard safety razor secure to facilitate honing or stropping the blade. U.S. Pat. No. 3,557,448 to Shead discloses a retractable razor blade holder to hold a standard safety razor, thereby serving as a replacement for the straight razor commonly used by barbers and hair cutters. U.S. Pat. No. 5,009,003 to Grange discloses a razor that has an improved handle to improve ergonomics and hand control.

There are other razor blade disclosures, beyond those disclosed above, that also disclose a device for shaving and cutting of hair. However, common amongst all of them of which I am aware is a lack of precise control that is needed to safely and conveniently distinctly shape and form the exterior edges of a hairline on a mustache or sideburn.

There are currently many devices that trim and cut hair by using a comb-like device with a sharpened edge interposed between the fingers of the comb. The following patents are representative. U.S. Pat. No. 1,976,290 to Motley teaches a comb type trimmer that has a blade exposed through the teeth of the comb portion. U.S. Pat. No. 2,568,368 to Sayer discloses a haircutting device that has teeth portions to guide and aid in cutting the hair. U.S. Pat. No. 1,217,288 to Donnelly discloses still another comb type safety razor holder that can be used to trim hair while keeping the blade away from the skin by the use of fingers or recesses. While all the aforementioned comb-like devices are sufficient for hair cutting, these devices also lack the ability to come in direct contact with the skin and shave off the hair at the surface of the face. Further, similar to the shavers discussed above, these aforementioned devices are large and cumbersome making minute manipulation very difficult.

Thus, there has been a need for some simple, inexpensive, lightweight device for enabling an individual to easily and accurately shape his own mustache and to do so even when the mustache hair is wet and lathered. The device must be able to effectively remove hair from the mustache at the peripheral edges and be capable of minute manipulation. In addition, it would be desirable to have an instrument which is sufficiently inexpensive so that it may be discarded and replaced frequently.

Further, there is a need to be able to trim the hair of the mustache with precision to form a uniform mustache line at the lip and above the mustache. This requires being able to not only trim the mustache hair but also be able to shave the hair at the skin line.

Therefore, there is still a need for a mustache shaving device which allows a user to precisely shave and shape the hair of his own mustache hair its peripheral edges, and to easily trim the remaining mustache hairs precisely to any desired length.

Thus, it is an object of the present invention to provide a class of mustache shaving devices which meet the foregoing needs and overcome the limitations of earlier mustache shaving or trimming devices.

An object of this invention is to provide a simplified, sharp edged, device which is small in size and lightweight and formed so as to be easily held between the user's thumb and forefinger and easily manipulated by the user for precisely shaving his mustache.

Another object is to provide a small, light weight fingertip shaver that has a fingertip grip portion positioned to allow the user to see what he is trying to shave and also to be able to shave or trim the hairs of his mustache without having his fingers, which are manipulating the device, come in contact with the face by the hand.

Yet another object of this invention is to provide a cutting device that utilizes a miniature razor blade which is considerably smaller than the standard 1½ inch long razor blade and that allows the user to have a much more sensitive touch when trying to shave the perimeter of his mustache.

Still yet another object of this invention is to provide a shaving device having a miniature cutter head, in which is mounted a thin metal strip having a razor sharp edge, and an integral handle portion which may be gripped between the user's fingertips, and a manually removable and replaceable, plastic cover which fits over, and is frictionally held upon, the cutter head for encasing the sharp edge.

One more object is to provide an accessory for a mustache shaving device which allows a user to easily manually trim his mustache hairs to one of a plurality of lengths predetermined by the size and arrangement of the accessory on the device.

SUMMARY OF THE INVENTION

This invention relates to simplified mustache shaving devices which are so small and lightweight that each can be easily gripped by a user between his fingertips for precise cutting and shaving of the peripheral edges of his own mustache. It also relates to special accessories and cases for my novel shaving devices which help make these precision shaving instruments more versatile and easy to use, and to transport and store.

In several embodiments of this invention disclosed herein, there is provided a mustache shaving device in the form of an elongated, narrow, body or strip having one end formed as a fingertip-grip portion and the opposite end formed as a cutter end or head portion. The fingertip grip portion is quite small and can also be properly considered or called a fingertip pinch grip tab. The lower side of the head is provided with a channel within which a narrow metal strip or blade is mounted. The blade has a sharpened edge of razor quality which extends outwardly of the channel so that this edge is exposed along a longitudinal side of the head. The razor sharp edge may be straight or curved, or may have both straight and curved sections. In addition, the blade edge may be blunted at one or both ends if desired to enhance a user's sense of control over the end sections of the blade edge.

My shaving devices are particularly useful for precisely shaving and shaping the upper edge periphery of the mustache beneath the user's nose including the sloped areas of the naso labial fold located between the nose and upper lip. Moreover, my shaving devices are sufficiently inexpensive in construction that each one may be readily discarded and replaced after a limited number of uses, thus providing the user with a device having a new, sharp razor edge, so that he can more effectively and precisely trim and shave the periphery of the mustache. My mustache shaving devices are very small and compact and are designed to be used in addition to, and as a useful supplement to, the standard razor blade systems for shaving. My devices will help the users thereof achieve a clean, smooth, shaped peripheral mustache line. Each of my designs provides a user with sensitive fingertip control. So each one will enable a user to trim and shave his own mustache to its optimal appearance without undue effort, especially after he has some practice with it.

The shaving devices of my invention, in addition to being small and lightweight, are each especially arranged so that they can be easily gripped by the user between his fingertips and manipulated by finger movement alone so that the user can more easily accomplish the precise cutting and shaving of the peripheral edges of his own mustache. In most of my embodiments, the shaving device comprises: (1) an elongated body having an elongated forward cutter end portion and an elongated rear fingertip pinch grip portion rigidly joined to the cutter end portion, and (2) a generally flat, elongated blade having an elongated razor sharp edge no longer than about an inch and having a substantially straight elongated dull edge section mounted to the cutter end portion. The fingertip grip portion has an overall size approximately as large the area between tips of the user's thumb and forefinger when the tips are pressed together. The overall size of the fingertip pinch grip portion is about as large as the overall size of the cutter end portion. The fingertip pinch grip portion has a major centerline or axis which is offset from the major centerline or axis of the cutter end portion in a direction that places the pinch grip portion further away from the sharp edge of the blade. In addition, since the head portion is located forwardly of the fingertip grip portion, neither the user's fingertips on the device, nor his fingers or hand obstruct his view of the razor blade as he watches himself in the mirror as he shaves his mustache and its periphery with the device.

Shaving and trimming of one's own mustache is often done while the hands are wet. The various embodiments of my invention preferably include one or more means to enhance the user's grip on the fingertip pinch grip tab. For example, several of my embodiments have a pinch grip tab provided with raised ridges, while others incorporate bumps or knurling to accomplish the same goal. In still other embodiments, the opposed surfaces of the fingertip grip portions are themselves shaped so as to provide added gripping security for the user. This is done by means of dished out portions or valleys on the fingertip grip portion to provide a comfortable seat for the finger and thumb as the device is manipulated against the user's face.

In several embodiments of this invention disclosed herein, a cover is provided to protect the user from inadvertent cutting by the sharpened edge of the razor sharp blade when the device is not in use. These blade covers can be either slipped on, snapped on or entirely encapsulate the entire shaving head of the device of the present invention. To further enhance the versatility of my razor blade shaving devices, I have provided special accessories, as part of my invention, that snap or slide onto the head of the shaving device to simultaneously provide both protection against the sharpened edge of the blade and to assist the user in trimming his mustache hair to a desired length. For example, a few embodiments of my slip-on guard cages of my invention have elongated fingers and slots, to provide a guard for the shaving blade while allowing the facial hair to be trimmed to length with a comb-like sweeping of the guard over the mustache. These guard cages can be symmetrical or asymmetrical in shape about the blade plane. My asymmetrical design allows the user to have three or more predetermined distances at which the blade may be held away from the skin. The specific distance depends on the thickness of the exterior walls of the slide-on cage between the exterior cage surface and skin. Still yet another embodiment features a guard cage which snaps onto the head of a mustache shaving device at any of several different heights relative to the sharpened edge of the blade. This type of adjustable cage allows my mustache shaving devices to be used in many applications such as trimming sideburns, short beards and/or eyebrows, as well as mustaches.

Still yet another accessory for my mustache shaving devices is a "steadyrest." This accessory is a detachable support structure which can be slid onto (and off of) the cutter end portion of the shaving device. It has an elongated planar guide or leg member extending downwardly, parallel to and offset slightly from the blade. This guide member extends the same distance from the main portion of the head as does the sharpened blade edge. The steadyrest assists the user in placing the sharpened blade against his face. Basically, the user can place the leg member against his skin first, and use it as a guide around which he can slowly pivot the attached shaving device until the blade-sharp edge just touches his face. At that point, the razor sharp edge is in position and ready to shave away unwanted stubble or any longer facial hair that is no longer wanted.

As mentioned above, my shaving devices are sufficiently inexpensive in construction that they may be readily discarded and replaced after a limited number of uses. However one of my embodiments goes one step further and allows the blade itself to be removed by a slidable cartridge. This allows the shaving device body to be used over and over, thereby further making this embodiment of the device even more inexpensive to use.

Several other embodiments of my mustache shaving devices have the blade sharp edge guarded but in a way which leaves the blade edge substantially exposed. In these designs, the sharpened edge of the razor blade is wrapped in a protective casing that exposes most of the blade while providing the user with a protective barrier over a portion of the sharpened edge to reduce the chance of accidental nicks or cuts. As mentioned above, the accessories also provide a degree of safety both in use and in storage. Because my mustache shaving devices and special accessories are sufficiently compact and versatile, they should prove to be a useful addition to every person's shaving or toiletry assemble.

To further facilitate the transport and storage and carrying the devices and accessories of my invention, I have provided specially-configured carrying cases to assist the user in safely carrying and storing my shaving devices. For example, all of my slip-on comb-like accessories can be used as a protective sheath. Also, I have included several specific carrying cases to achieve a similar goal. One of such case is a foldable plastic shell in which the mustache shaving device is inserted into a custom-formed half-chamber of the shell and a flexible hinge allows the second half of the shell, which is a mirror image of the first half, to fold over and snap together, thereby encasing the shaving device. Another is a flexible pouch carrying case that has a snap closure positioned to create a locking pocket conforming to the shape of and snugly retaining the shaving device therein.

Lastly, I disclose a custom carrying, display and storage tray for multiple identical mustache shaving devices of the present invention. A first device (which may be the unit currently in use by its owner) is inserted in horizontally-formed pocket which has room for the cage or cover accessory already attached thereon. The tray also has four vertical custom-formed slots to receive four identically-shaped replacement mustache shaving devices. The orientation of slots is alternated to provide a more compact package.

Most, if not all, of my mustache shaving devices, especially those that are assembled from pre-formed plastic pieces with separate blade strips, can be efficiently constructed and economically mass produced using technology and automated assembly techniques similar to that employed in current manual safety razor constructions. In particular, all molded plastic components for my mustache shaving devices can be made from conventional plastic materials using readily available molding machinery with dies that have been machined to produce finished parts, such as, for example, the integral fingertip grip and cutter head. The metal blade strips may be made with or without registration holes for receiving locating pins or protrusions in the cutter end of the head. Such metal blade strips can be sharpened along one edge and then cut to length using conventional equipment. Special fixtures and locator tooling can easily be made to allow the custom components of my mustache shaving devices to be automatically assembled at a very low cost. Thus, engineers in the safety razor field and users of wet shaving razor systems will recognize my mustache shaving device designs and accessories can be readily manufactured by using selected various manufacturing techniques already known as part of the predominant wet shave razor blade system manufacturing technology in use today.

Other objects, features, operating principles, and advantages of the mustache shaving devices of the present invention will become apparent upon studying the various Figures in the drawings and reading the following detailed description and subjoined claims.

BRIEF DESCRIPTION OF THE DRAWINGS

In the drawings, many different embodiments of the mustache shaving devices and related accessories of the present invention are shown. For purposes of illustrating the features and advantages of the present invention, the figures, in the interest of clarity, at times exaggerate somewhat the size, spacing, clearances and/or relative sizes of or between certain parts of my shaving devices, including their cutter portion or fingertip grip portions. In the various Figures, like reference numerals indicate similar components or features, and the Figures may be briefly described as follows.

FIG. 1 is a perspective view of the shaving device having a dimpled pinch grip tab and a cutter head with its blade sharp edge enveloped by a head cover;

FIG. 2 is a perspective view of a like device 10' with diagonal gripping ridges and with the head cover removed; and FIG. 3 is a side elevational view of the device 10" with two sets of crossing gripping ridges, with the cover removed and with the cover shown in cross-section.

FIGS. 4 through 6 show various views of a second embodiment 20, similar to the first embodiment, but with longer pinch-grip and cutter head portions, where:

FIG. 4 is a perspective view, partially shown in phantom due to a partial cross-section being taken in the direction of arrows 4—4 of FIG. 3, which shows the blade disassembled from the head of the instrument;

FIG. 5 is an enlarged cross-sectional view of the device's head; and

FIG. 6 is a cross-sectional elevational view, similar to FIG. 5, but showing the cover in position upon the head.

FIG. 7 is a perspective view of a third embodiment 30 having a multiple-pin arrangement for engaging the blade, with the blade separated from the body of the device for illustration purposes.

FIG. 8 is a perspective view of a fourth embodiment 40 similar to the third embodiment, but having the front and rear corners of the blade covered.

FIG. 20A shows a removable attachment referred to as a steadyrest or shaving guide, and FIG. 20B shows the steadyrest installed on the shaving device and being used to guide its razor-sharp edge along a user's skin.

FIGS. 24A–24E show a seventeenth embodiment 180 of the shaving device of my invention, with an assembled cutter head which has a sharpened guard corner portion and a blunted blade edge portion, where: FIG. 24A is an exploded side elevational view, FIG. 24B is an assembled bottom view; and FIGS. 24C and 24D are enlarged fragmentary views from the side and front of the forward end of cutter head.

FIGS. 25A, 25B and 25C are a side elevational view, a front end view and a top view respectively of an eighteenth embodiment 230, with an oval fingertip grip portion and a front cutter portion having a pair of glide strips positioned near the sharpened edge the razor blade strip.

FIGS. 26A–24C show a nineteenth embodiment 250 of my invention, which also includes lubricated glide strips, where: FIG. 26A shows a side elevational view.

FIGS. 27A–27B show a twentieth embodiment 280, with FIG. 27A being a side elevational view thereof that reveals a blade strip enclosed within intermediate finger-like guards that leave the sharpened blade edge substantially exposed to permit shaving of the skin adjacent the mustache periphery, and FIG. 27B being a front end view thereof;

FIGS. 28A–28B show a twenty-first embodiment 300, like the FIGS. 27A–27B device, but having a removable, replaceable blade cartridge, with FIG. 28A being an perspective view showing the blade cartridge removed, with FIG. 28B being a slightly enlarged exploded view of the removable cartridge, showing its three parts which snap together; and FIGS. 29A–29C illustrate a twenty-second embodiment 320, similar to the FIGS. 27A–27B device, which features a blade strip having its sharpened partially shrouded in a folded metal guard perforated with three holes to expose portions of the sharpened blade.

FIG. 30A shows the device pinched between a user's forefinger and thumb, and FIG. 30B dearly shows the offset pinch grip tab portion, and FIG. 30C shows the assembled blade construction, including three locating pins.

FIGS. 31A and 31B are side elevational and right end views respectively of the device, and FIG. 31C and 31D are exploded end and bottom views respectively of the device, and FIG. 31E is an interior side view of one of the half-shells.

Figures 34A, 34B, 34C, 34D, 34E:
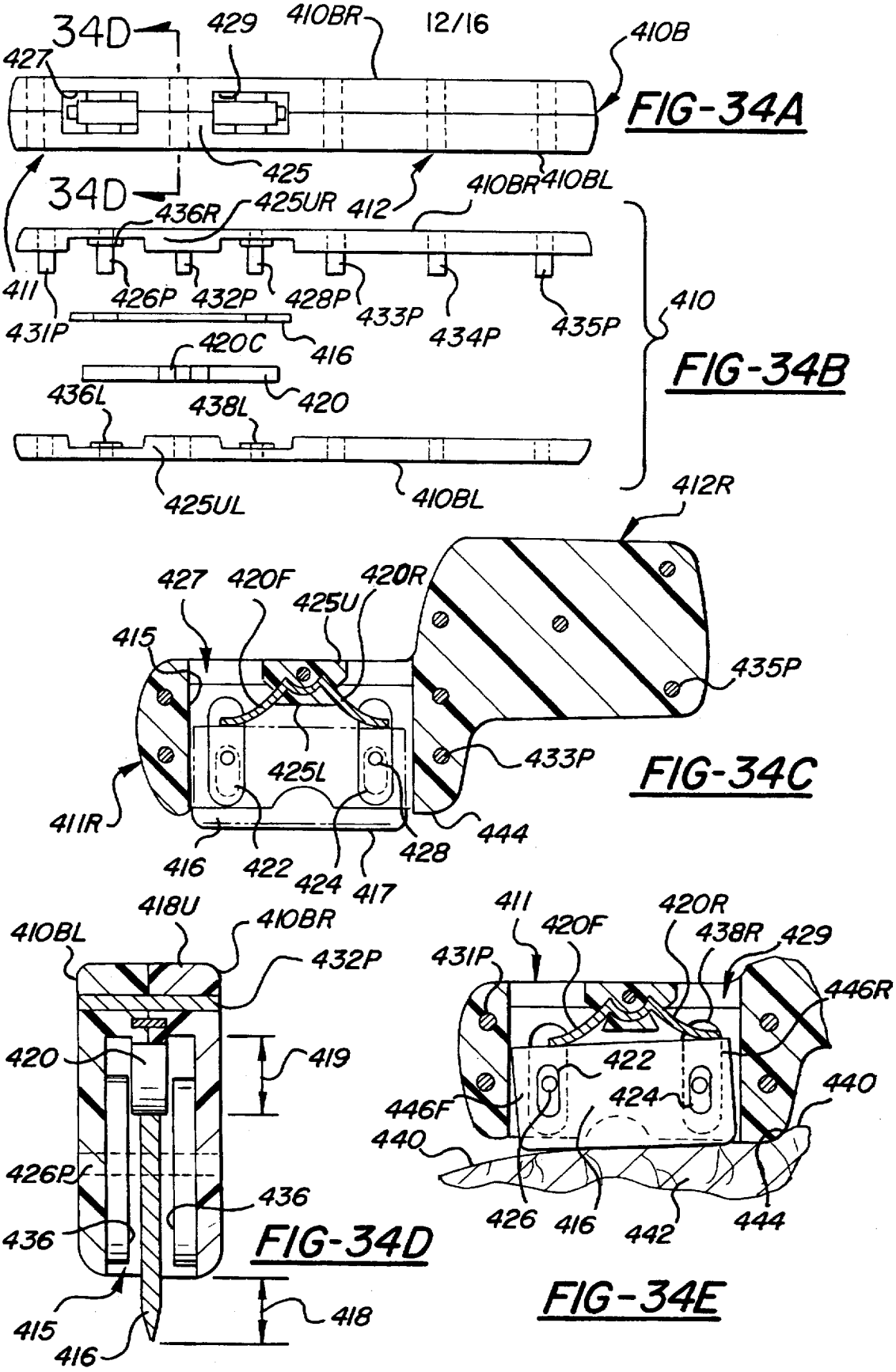
FIGS. 34A–34E show a twenty-seventh embodiment 410 of the mustache shaving device having a movable spring-loaded blade strip, where.

FIG. 34A is a top view of the device; FIG. 34B is an exploded top view; FIG. 34C is a side cross-sectional view; FIG. 34D is an end cross-sectional view taken along line 34D—34D of FIG. 34A; and FIG. 34E is a view like FIG. 34C, which shows the blade strip placed against the user's skin so as to depress the right end of the blade strip.

FIGS. 35A and 35B show a twenty-eighth embodiment of the present invention, namely a combined slide-on cover guard and trimming accessory 460 that encapsulates the sharpened edge of the blade and has comb-like fingers, where: FIG. 35A is a perspective view of the slide-on cover guard cage being applied to a typical embodiment of my invention and FIG. 35B is an end cross-sectional view of an alternate slide-on guard 460' installed on the cutter head of the FIG. 34A device taken in the center thereof.

FIGS. 36A and 36B show a twenty-ninth embodiment of the present invention having a push-on cover guard and trimming accessory 490 encapsulating the sharpened edge of the blade and having comb-like fingers similar to that of FIGS. 35A–35B cover guard, where: FIG. 36A is a perspective view of the push-on cover guard cage applied to a grooved cutter head of a typical embodiment of my invention; and FIG. 36B is an end view of the push-on guard and cutter device showing the guard installed in the second of four sets of positioning grooves.

Figures 37A, 37B, 37C, 38A, 38B, 38C:
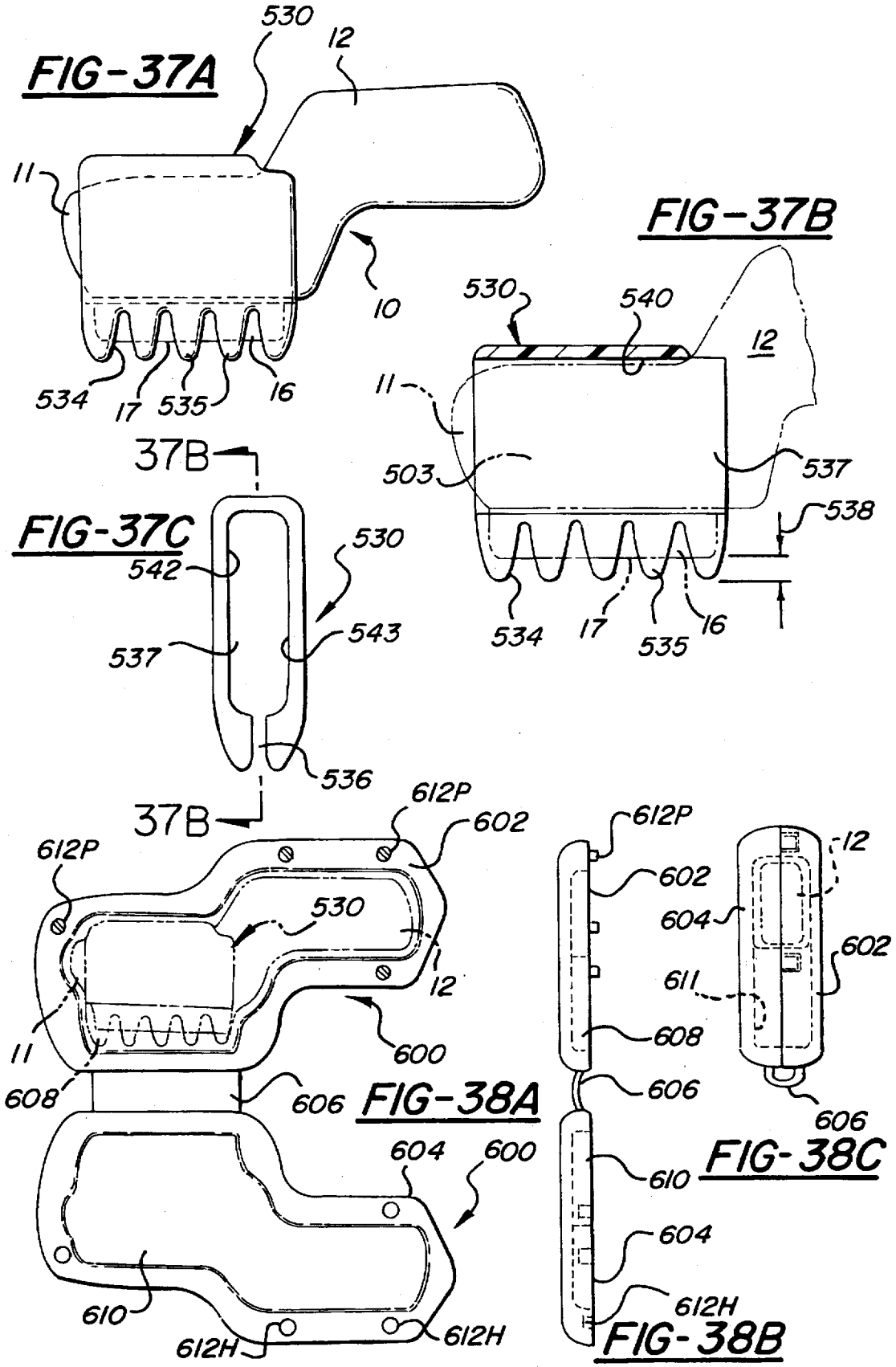

FIGS. 37A, 37B and 37C show a thirtieth embodiment of the present invention, with FIG. 37A being side perspective view of a removable asymmetrical trimming gauge 520 accessory installed on a typical one of my mustache shaving devices having a fully exposed substantially straight cutting edge, FIG. 37B being a slightly view like FIG. 37A but in longitudinal cross-section, and FIG. 37C shows the same accessory from an interior enlarged fragmentary side view in longitudinal cross-section with the mustache shaving device of the present invention shown superimposed in phantom.

FIGS. 38A, 38B and 38C show a thirty-first embodiment of the present invention, which is a protective carrying case 540 preferably formed as a one-piece plastic snap-together case, where FIG. 38A is a perspective side view of the carrying case in the open position highlighting the inner pocket for receiving one of my mustache cutting devices of the present invention, such as the FIG. 37A device; FIG. 38B is an end view of the carrying case in the open position illustrating the fastening posts and receivers in the upper and lower portions; FIG. 38C is an end view of the carrying case in the closed position showing the compact form and design.

FIGS. 39A, 39B and 39C show a thirty-second embodiment 320 of the present invention, namely accessory of the present invention in the form of a flexible plastic sheet carrying case with a snap-style button fastener for holding any one of my mustache shaving devices, where: FIG. 39A is a perspective side view of the carrying case in the closed position showing a typical mustache shaving device of the present invention with trimming accessory enclosed therein; FIG. 39B is an end view of an empty carrying case illustrating the snap button closure in its unfastened state; and FIG. 39C is an end view of the carrying case in the closed position with the snap fastened and having a one of my mustache shaving devices secured within.

Figure 40B:
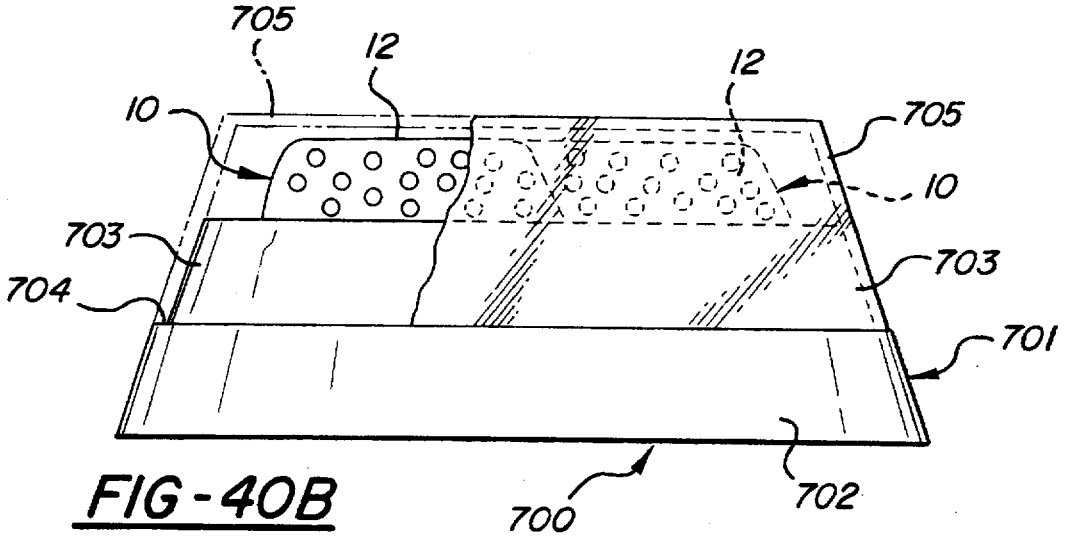
Figure 40C:
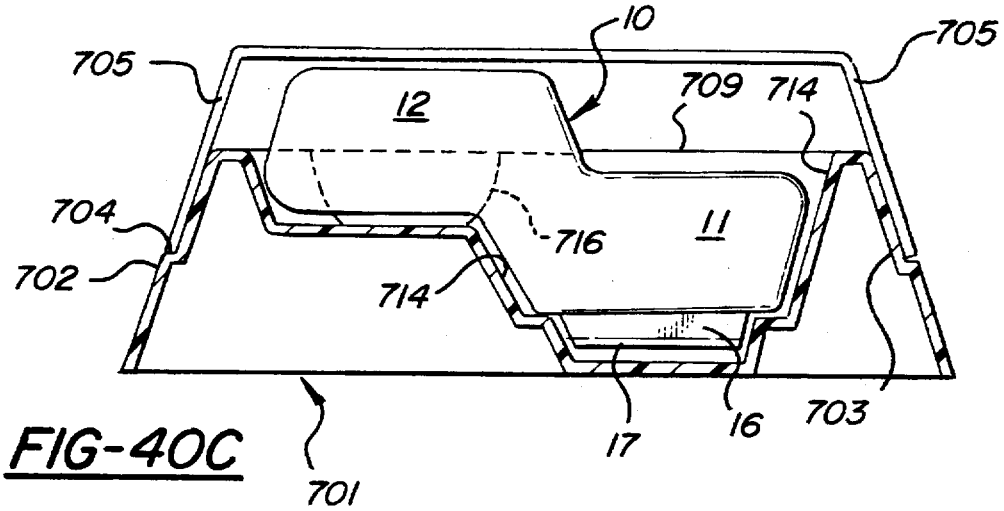
Figure 40D:
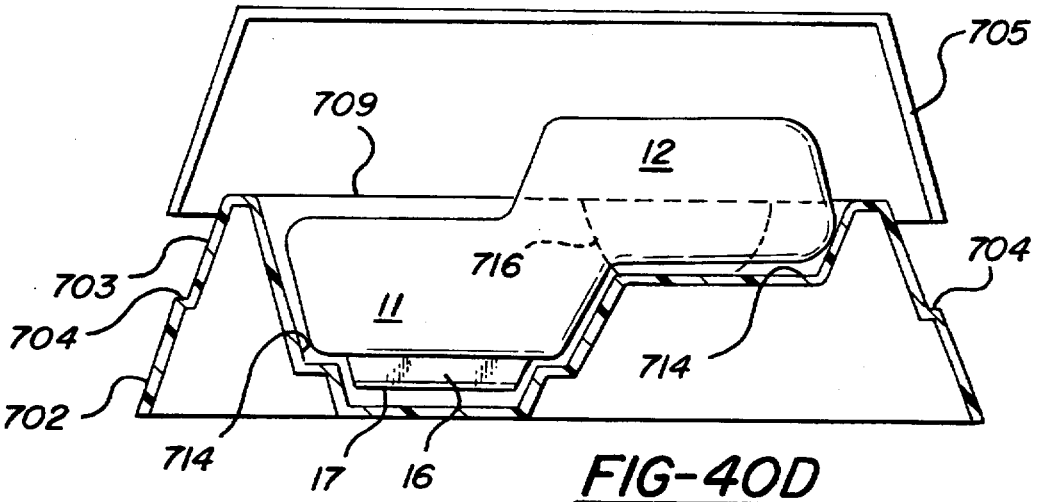

FIG. 40A–40D show in four views a thirty-third embodiment 330 of the present invention, which is of a storage/transport container system which has vacuum-formed plastic base and a transparent lid for holding five typical mustache shaving devices of the present invention, where: FIG. 40A is a top view of the container system with its lid mostly cut away to reveal shaving units in the conforming slots and two empty slots; FIG. 40B is a side elevational view with the lid mostly partially cutaway; FIG. 40C is a side cross-sectional view taken along line 40C—40C of FIG. 40A showing the lid and shaving unit in place; and FIG. 40D is a side cross-sectional view taken along line 40D—40D of FIG. 40A showing the transparent lid being removed.

DETAILED DESCRIPTION OF THE PREFERRED EMBODIMENTS

The following detailed description of various embodiments of the mustache shaving devices and related accessories and cases of the present inventions are presented by way of example only and are not intended to limit the inventions to just those embodiments shown. This description is intended to enable one skilled in the art to make and use the structures of inventions in many forms. Thus, the overall scope of my inventions here should be understood to encompass the adaptations, variations, alternatives and different uses of the devices, accessories and cases that are described herein or are logically derived from the teachings herein.

Most of my mustache shaving devices, accessories and cases disclosed herein have structures that are symmetrical about their central longitudinal plane. In most of my shaving devices for example, the overall appearance and structure, including the cutter head portion and pinch grip portion, is symmetrical about this plane, which the razor blade strip also lies in. Unless otherwise indicated or shown to be asymmetrical, then, my devices, accessories and cases should be assumed to be symmetrical about their central plane. Thus, those in the art should appreciate that the descriptions herein of one side, end, or section of any given razor head portion or rear fingertip grip portion will also serve to describe the other half of the generally symmetrical structure on the opposite side of this central plane.

Figure 1:
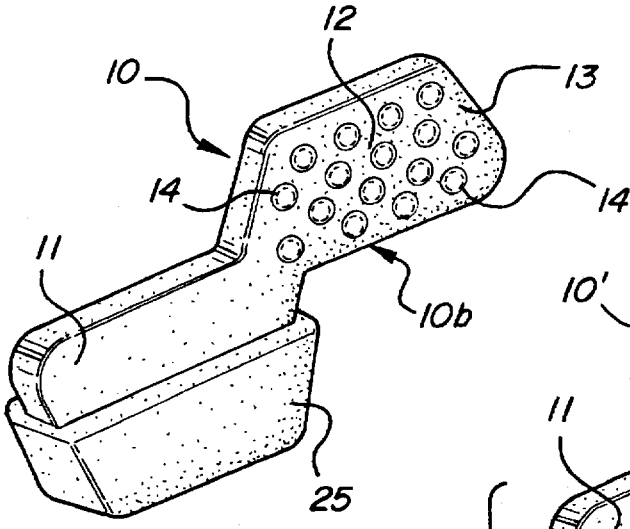
FIGS. 1 through 3 show various views of a first embodiment 10 of a mustache shaving device of the present invention, where.
Figure 2:
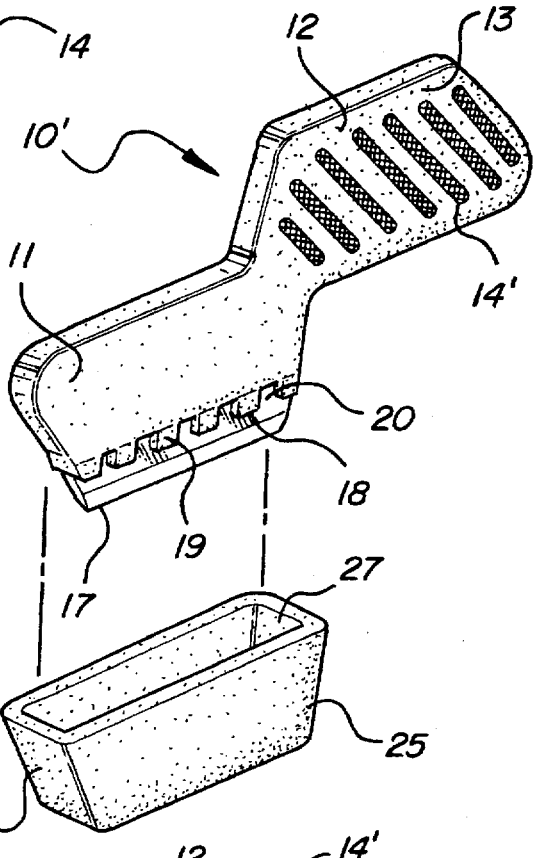
Figure 3:
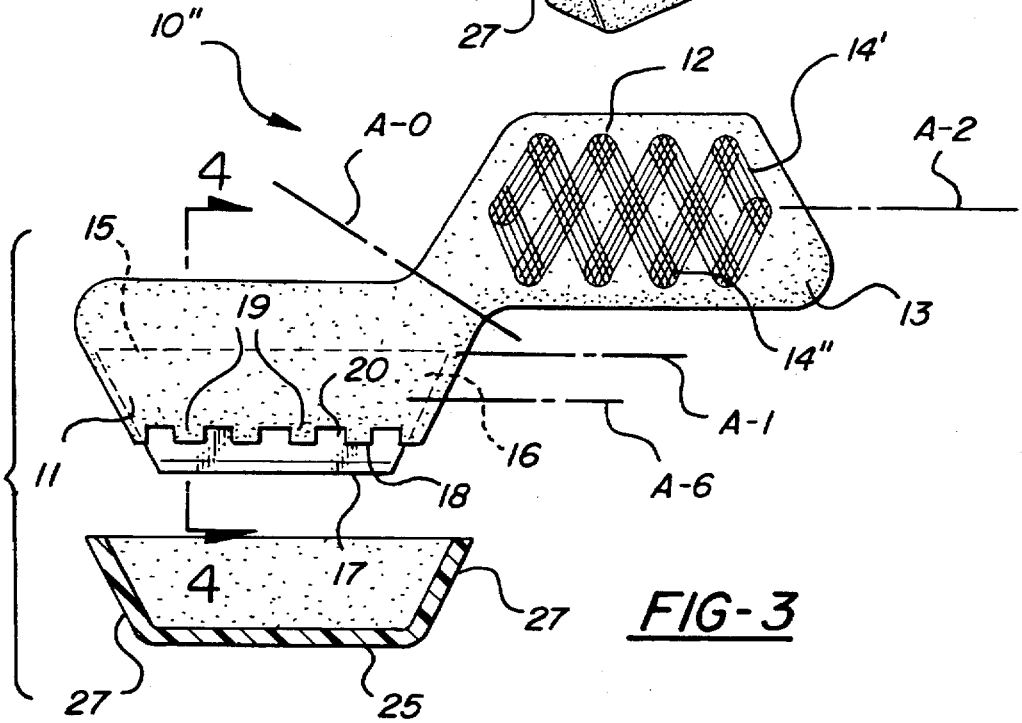
Figure 10:
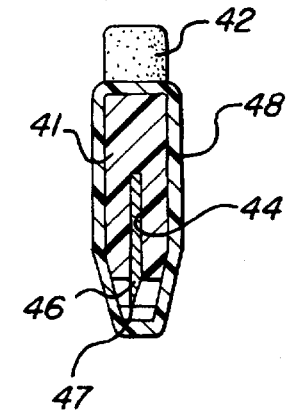
FIG. 10 is an enlarged cross-sectional view taken in the direction of arrows 10—10 of FIG. 9 with the cover in position.

FIGS. 1,2 and 3 illustrate three versions of a single mustache shaping and trimming device 10 having an elongated, flattened body 10B of the same overall size and shape. The body may be made of a molded plastic material or of a metal stamping or casting. The body of the device is divided into a head portion 11 and an integral fingertip grip portion 12, which allows the user to pinch and securely hold the portion 12 with just two of his index fingertip and thumb tip. For this reason, I often refer to this fingertip grip portion as the pinch grip tab. Head portion 11 and pinch grip portion 12 each have a trapezoidal appearance when viewed from the side. Each pinch grip portion 12 has two substantially flat side surfaces 13. Enhanced gripping means, in the form of raised textured surfaces, are provided on the side surfaces 13 of each of the devices shown in FIGS. 1,2 and 3, and represent the differences therebetween. In device 10 shown in FIG. 1, a series of rows of spaced raised bumps 14, which are each preferably substantially hemispherical in shape, form the enhanced gripping means. In FIG. 2, device 10' has provided with enhanced gripping means on side surfaces 13 in the form of raised diagonally arranged ridges 14' which have a pebbled texture achieved by a fine cross-hatching of the raised surface of the ridges. In FIG. 3, the enhanced gripping means of device 10" is in the form of checkered grips on surfaces 13 formed by a series of raised ridges 14' and 14" that criss-cross one another. For improved appearance, the raised ridges 14 and 14" in FIGS. 2 and 3 are arranged to be parallel to the sloped front and rear end surfaces of the pinch grip tab 12.

The overall length of all my different embodiments of shaving devices is relatively small, as for example, on the order of no more than 2 to 2½ inches (5 to 7.5 cm) long, with a preferred length being between 1.5 inches (3.7 cm) to no more than about 2 inches (5 cm). The blade strip in all my embodiments is preferably no more than about 1.0 inches (2.5 cm) long, with 0.5 inches (1.3 cm) to 0.9 inches (2.3 cm) being a preferred range for the sharpened portions of blade lengths, and with ¾ inches (1.9 cm) or less being the most preferred range. In addition, the grip portion may be and preferably is axially aligned with the head, that is to say, the axes of both the head portion and the grip portion lie in a common plane.

As best shown in FIG. 3, the body 10B is symmetrically arranged about a central axis A-0 which is diagonal to the longitudinal axis and major centerline A-1 of the head portion and to the longitudinal axis and major centerline A-2 of the pinch grip tab portion 12. These axes A-0, A-1 and A-2 all lie in the common plane. The axes A-1 and A-2 are arranged parallel to the longitudinal axis A-6 of the blade 16. As shown, the head portion 11 has its centerline A-1 offset from the centerline A-2 of the pinch grip portion 12 in an upward direction that places the pinch grip portion further away from the sharp edge 17 of the blade 16. This offset arrangement, which is used in all my shaving devices herein, helps ensure that the user's fingertips will not collide with or brush against his skin as he uses the instrument 10. In addition, the grip portion is offset rearwardly from the head portion 11 so that his fingertip grip on the pinch grip tab 12 will not obstruct his view of the edge 17 of the razor strip 16 as he views and supervises his own shaving operation in a mirror to ensure accurate results. Thus, it is to be understood that the pinch grip tab portion 12 is offset in two ways (upwardly and rearwardly) from the head portion 11 that holds the razor sharp blade. This double offset arrangement is one of the things that makes my mustache shaving devices so easy to use.

The head and pinch grip portions of device 10 each have a trapezoidal appearance when viewed from the side as best shown in FIG. 3, and the two portions 11 and 12 are substantially the same in size. This results in a balanced appearance which may be said to be pleasing or ornamental in nature. However, these two body portions do not need to be made the same size or shape.

The small overall size of the device 10 permits fingertip holding of the device, which results in better control of the cutting and shaving action. This enables the user to shape and shave his mustache with precision. Precise control and positioning is further facilitated by the light weight of the device, as well as by the double-offset arrangement of body portions 11 and 12, as explained above. The combination of all of these features allows a user to pinch the tab or grip portion of any one of my shaving devices between his fingertips and use the blade by stroking it across his skin at the edges of his mustache in order to reshape the periphery of his mustache to his liking. Unlike the larger prior art devices which required movement of the hand and wrist to manipulate, all of my mustache shaving devices allow stroking of the razor-sharp blade by fingertip movement, which is especially important when detailing the finely shaped edges or periphery of popular precision mustache styles.

FIGS. 4 through 6 show a second embodiment 20 of the mustache shaving device of the present invention, which has a pinch grip tab portion 12' which is somewhat longer and less tall than the tab portion 12' of FIGS. 1–3. It has a substantially smooth side surface 13'. Otherwise, the device 20 is substantially identical to device 10 shown in FIGS. 1–3.

In shaving devices 10 and 20, head 11 is provided with a slot-like channel 15 which extends its full length. A single edge, flat, narrow, strip steel blade 16 is inserted in the channel 15 and is fastened therein. The blade may be fastened in place during the molding of the plastic head. The blade has a sharpened edge 17 which extends laterally outwardly of the longitudinal edges 18 which define the channel 15. The free edges 19 of the channel may be straight or may be provided with fingers 19F separated by notches 19N.

The corners 21 that are formed at the opposite ends of the edge 17, of the strip-like blade 16, are preferably blunted. This may be accomplished by angling the opposite blade ends 22 at an obtuse angle relative to the blade sharpened edge 17. Otherwise, the corners 21 may be blunted by rounding them somewhat. This blunting enables the user to apply greater pressure on the sharp edge of the blade to enhance the cutting action while trimming and shaping the mustache, without puncturing the skin which might otherwise happen on an extremely sharp corner. The blade length is long enough to easily maintain a repeated straight edge cut. However, it is short enough, so that it can easily allow cutting convex or concave, as well as straight, lines for various mustache shapes or trimming the sloping areas of the naso labial fold between the user's upper lip and nose.

The mustache shaper systems shown in FIGS. 1–6 include a narrow trough shaped plastic cover 25 for covering the sharp edge and the adjacent portions of the head. The opposite ends 27 of the cap are closed for closely containing the sloped ends of the head. Alternatively, one or both of such ends may be open, so long as the sharpened ends of the blade remain safely guarded. The cover is shaped and sized to snugly fit over, and to grip, the head frictionally. Thus, it may be removed forcibly by manually pulling it off the head or it may be manually pushed into position upon the head for covering and protecting the head and blade when desired.

With the constructions shown in FIGS. 1–6, the user may shape his mustache by gripping the pinch grip portion between the tips of his thumb and forefinger and then controllably moving the blade edge upon the peripheral edges of the mustache hairs and over the skin, where no mustache hairs are desired. This enables the user to precisely shape the mustache upper and lower peripheral edges located near the nose and above the lip, such as for forming a "pencil" style mustache or the like. Since the blade is short, it can easily shape the hair in the facial depression above the upper lip and shape the hair evenly on both sides of the mustache to any desired design. My mustache shaving instruments may be used once or a number of times. Because of their low unit cost and relatively small size, each of the instruments can be disposable, that is, it can be thrown away after a few uses and replaced with a like device.

Preferably, the body of my mustache shaving devices are each molded of a suitable, conventional plastic. The blade, in that case, may be held in the channel by the plastic material that is molded around it. However, the blade may be placed within a pre-molded body and then secured within the channel in the head by some suitable adhesive or by mechanical fastening means.

FIG. 7 shows a modified shaving device 30 wherein the blade 16' is positioned against an exposed surface 39 formed on the head 31 of a body 30B. The body may be made of molded plastic, or cast metal or the like. The blade 16' may be fastened to the body by a flat blade bar or blade cap 33 having integral pins 34 which extend through openings 35 in the blade and are seated in corresponding holes or sockets 36 formed in surface 39 of the head 31. The pins may be press fit into the holes for frictional fastening therein or may otherwise be fastened within the holes in any suitable manner. It should be appreciated that, if desired, the location of the registration pins 34 and receiving sockets 36 may be interchanged. In other words, the registration pins may be integrally molded as part of body 36, and corresponding registration holes provided in the cover 33.

FIG. 8 illustrates a modified shaving device 40 having a head 41 and fingertip pinch grip 42. Blade 46 is encased within a pocket 45 formed in the head so that its sharp edge 47 is exposed, but the corners at ends 43 of the blade are covered by extensions 44. The device 40 may be formed of a plastic molding with the blade embedded in the head during the molding process.

Figure 9:
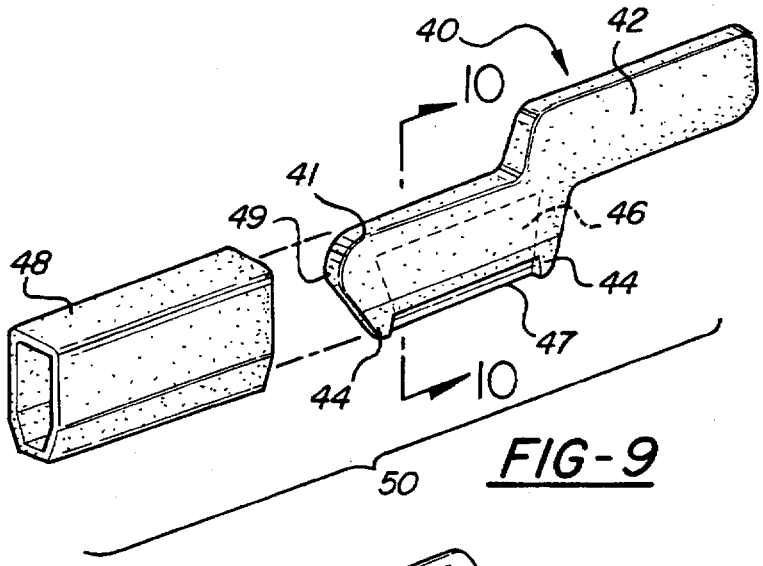
FIG. 9 is a perspective view of a fifth embodiment 50, shaped like the FIG. 7 device, but similar to the FIG. 8 device, having a sleeve type of cover that is shown removed from the cutter head.

FIGS. 9 end 10 illustrate a fifth embodiment, namely manual mustache shaving system 50, which features the application of a sleeve-like cover 48 over the head 41 of the device 40. The cover is preferably made from plastic material resistant to cuts. The cover may be an open ended tube, as illustrated, or have one dosed end. As illustrated in FIG. 9, the cross-sectional shape of cover 48 may be formed to conform to and snugly slide and fit over front end 49 of head 41, so that the cover is frictionally held upon the head and covers the exposed sharp edge 47 of the blade 46.

Figure 11:
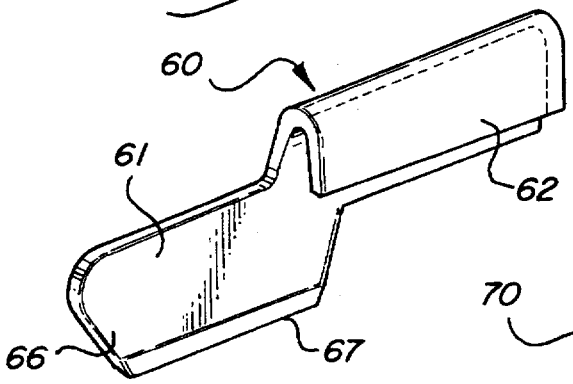
FIG. 11 is a perspective view of a sixth embodiment 60 formed from bent sheet metal.

FIG. 11 is a perspective view of a mustache shaping device 60 which is formed of a single sheet of metal bent or stamped into a double bent head portion 61 and a pinch grip portion 62. Head portion 61 forms an integral blade section 66, whose free edge 67 is sharpened to form a razor sharp cutting edge.

Figure 12:
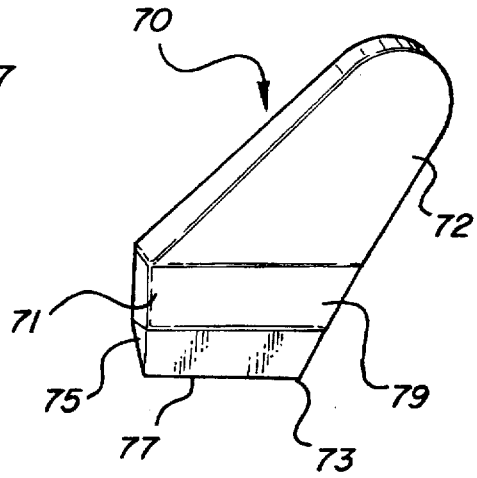
FIG. 12 is a perspective view of a seventh embodiment 70 formed of sintered metal, such as a hard carbide, and having a flying wedge shape.

FIG. 12 illustrates a one-piece, bar-like mustache shaping device 70. The device may be made of sintered metal material, such as, a hard carbide, using conventional sintering and molding techniques. One end of the device provides the head portion 71 and the opposite end forms the fingertip grip portion 72. The free end 79 of the head may be bevelled as shown at location 75 with a sharpened razor cutting edge 77 ground upon the edge of the bevel 75. Preferably, the bevelled free end is angled relative to the bar, as illustrated, and its corner 73 is blunted by the angled corner area. The user grips the pinch grip portion 72 of the bar and guides the sharpened, angularly inclined, bevelled edge 77 to controllably cut, trim and shape his mustache hair.

These trough-like or sleeve-like covers described above may be constructed for use with any of the devices described in this specification. The use of a cover with any one of my mustache shaving devices results in a convenient manual mustache shaping system which is sanitary, safe, easily usable and sufficiently inexpensive that it may be discarded after a limited number of uses. Further devices and accessories will also be described to show further ways in which the mustache shaving systems of the present invention may be implemented.

Figure 13:
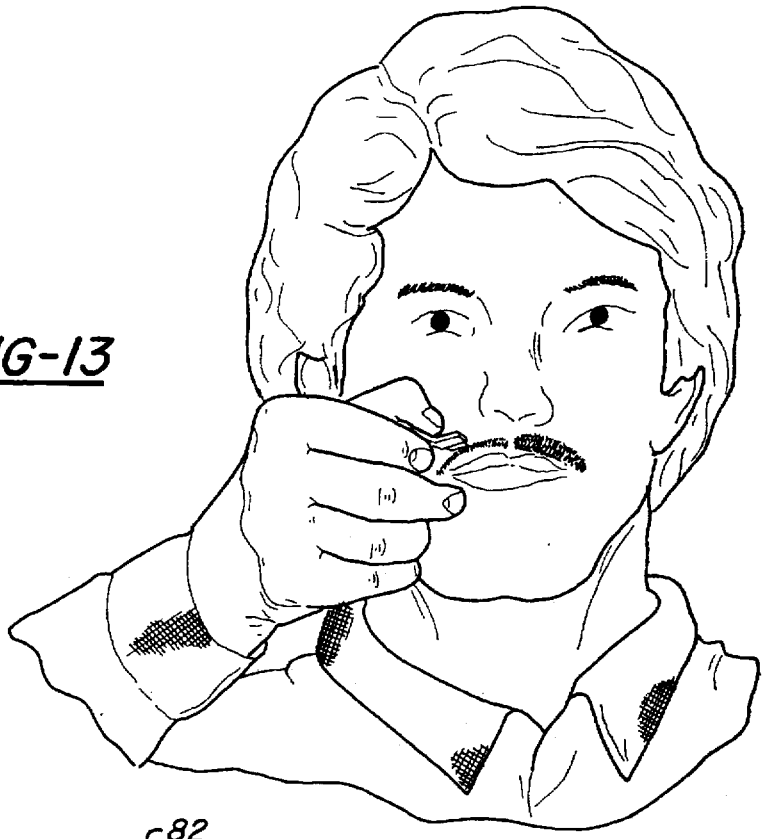
FIG. 13 is a view of a typical user holding, between the tips of his thumb and forefinger, a typical mustache shaving device of the present invention by its pinch grip tab portion to part of his mustache in order to shape the peripheral line of his mustache.

FIG. 13 shows a user grasping one of my mustache shaving devices (such as the FIG. 14 device). He is applying the sharpened edge of its razor blade strip to his face at the periphery of his mustache. He is holding the device by its pinch grip tab using the forefinger and thumb of his right hand. The other three fingers of his right hand are free, and may be used as shown to help steady his hand by placing one or more of those fingers against his face. By using this kind of fingertip pinch grip, and by looking in a mirror, the user of any of my mustache shaving devices is easily able to shape his mustache on all sides, as desired. The razor sharp edge of my shaving devices allows the user to not only trim the mustache hair that is to remain, but also to shave unwanted mustache hair or stubble from anywhere around the periphery of his mustache, even in the naso labial fold.

Figure 14A:
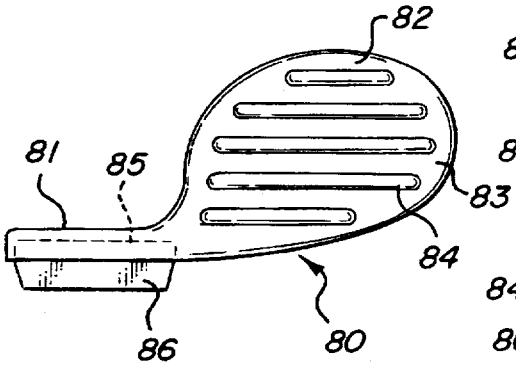
FIGS. 14A, 14B and 14C are a side elevational view, a front end view and a top view respectively of an eighth embodiment 80 of the mustache shaving device of the present invention, which has a fully exposed blade and a raised ridges on the fingertip grip portion thereof.
Figure 14B:
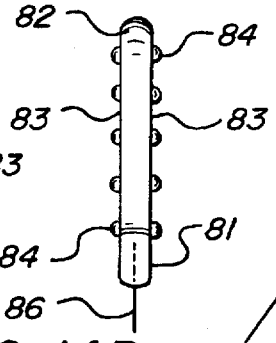
Figure 14C:
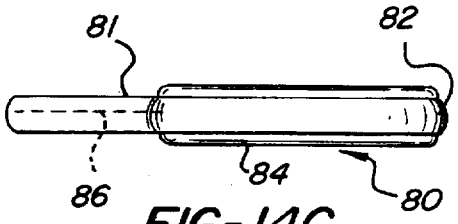

FIGS. 14A–14C show an eighth embodiment of my invention, namely mustache shaving device 80. Its body is formed of a cutter holding portion 81 and an integral fingertip pinch tab portion 82. As in my other shaving devices, its body is a rigid structure which allows a user to apply force at pinch grip tab 82 and have that force transmitted directly to the cutter head 81 with minimal deflection. As in my previous embodiments, cutter holding portion 81 may be provided with a slot or channel 85 which extends substantially its full length, so that a flat narrow metal blade strip 86 can be inserted therein as shown.

Side surfaces 83 of pinch tab portion 82 are provided with a series of horizontally arranged spaced raised ridges 84. Like the ridges 14' and 14" in FIGS. 2 and 3, these ridges 84 provide an enhanced gripping surface that helps prevent the shaving device from rotating in the user's fingertips as the blade is pressed against his facial hair or adjacent skin. All of these raised ridges are preferably large enough, high enough and sufficiently separated or otherwise sufficiently roughly textured to give a user a secure grip and a good tactile feel.

Figure 15:
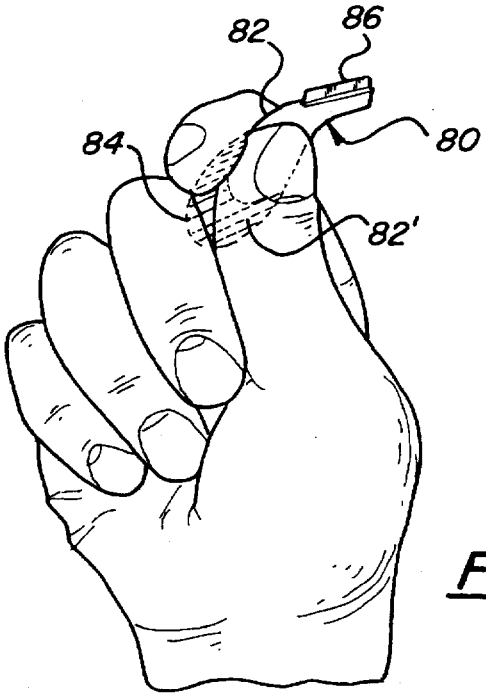
FIG. 15 is a perspective view of the FIGS. 14A–14C mustache shaving device 80 held in a user's hand showing the approximate size of the device, and the interference effects when a fingergrip tab portion is too big.

FIG. 15 is another view of device 80 held by a pinch grip between the tips of a user's thumb and forefinger. FIG. 15 also illustrates the importance of having the pinch grip tab be sufficiently small, rather than too large, as will now be explained. A tab portion that is too large is represented by tab portion 82'. The extra area of tab portion 82' that extends beyond tab 82 is lined with dashes for ease of identification. Tab 82', in my view is too large, because it protrudes beyond the tips of the gripping finger and thumb, and thus its rear area 84 may accidentally rub against the user's central finger. This kind of interference is undesirable, since it hinders making precise fingertip movements of the blade. Avoiding this potential problem is one of the reasons I strongly prefer that my mustache shaving devices to be two inches or less in overall length, and to have a fairly small gripping area just large enough to accommodate a fingertip pinch grip of an average size man's hand.

FIGS. 16A–16D, 17 and 18 show the ninth through eleventh embodiments of my mustache shaving devices. These three embodiments respectively illustrate that the shape of the pinch grip tab portions, when viewed from the side, may be a square, a tear-drop shape, or an upright rectangle. The embodiments shown in FIGS. 21 through 23 show that the pinch grip tab portion may be circular, semi-circular or oval, and that pinch grip portions may be inclined at an angle relative to the cutter head. The pinch grip tab portions may also be made in other shapes as well. Also, in the embodiments shown in FIGS. 16 through 18, at least one portion of razor sharp edge of each blade is shown to be curved. Each of these designs will now be briefly reviewed.

In FIGS. 16A–16D device 90 includes cutter holding portion 91 and square pinch grip portion 92 which share a common edge surface, namely lower edge 93. The pinch grip portion may be etched as shown with a criss-cross hatching to improve gripping. A pocket 95 is provided in head portion 91 and receives the upper section of blade strip 96. A razor sharp edge 97 that is substantially straight extends a short distance (0.2 mm to about 0.7 mm) below lower edge 93. Forward end 98 of the blade sharp edge 97 is in the form of an arc such as quarter circle. Rear edge 99 of blade 96 is angled, and may be blunted if desired.

Figures 16A, 16B, 16C, 16D, 17, 18, 20A:
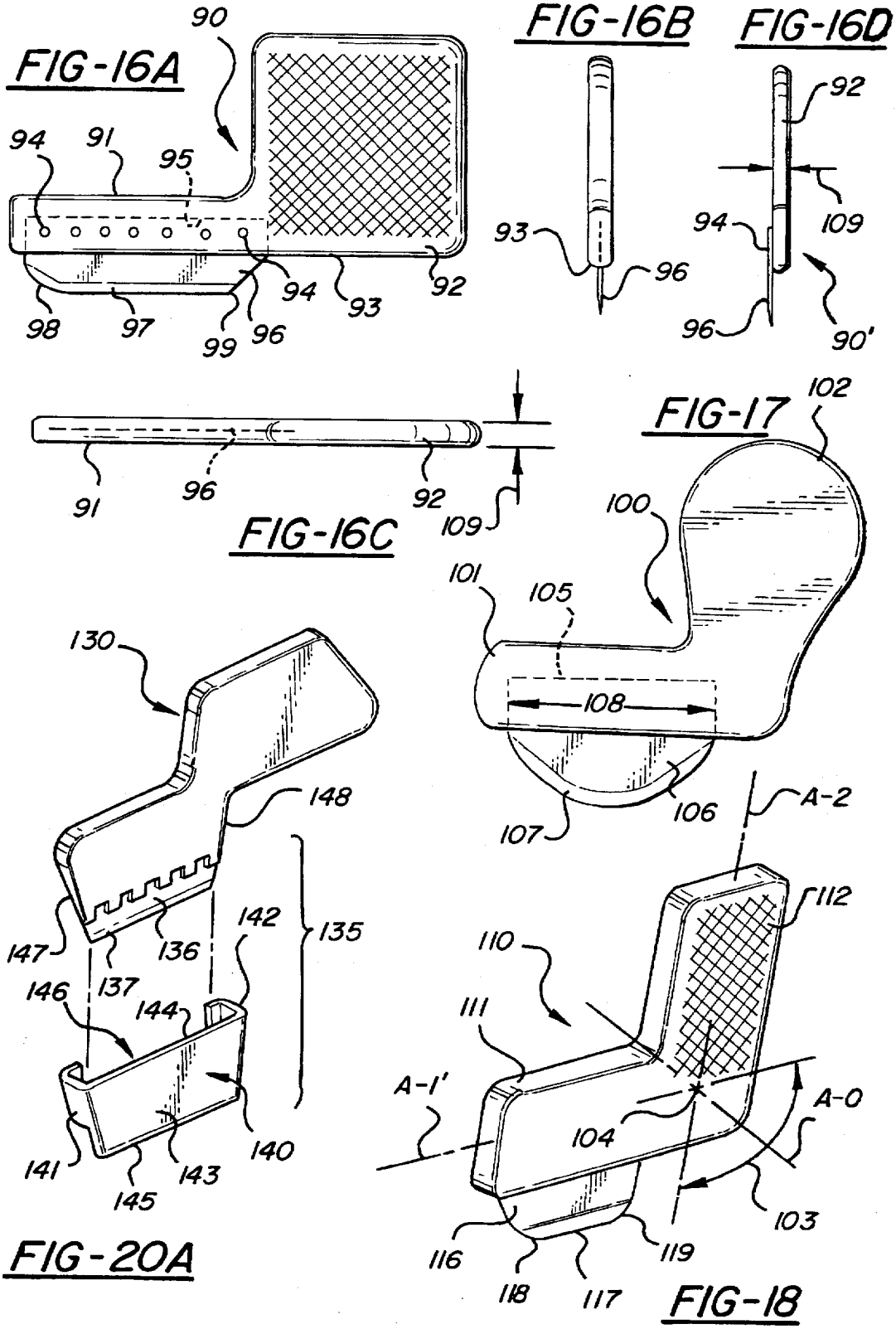
FIGS. 16A, 16B and 16C are a side elevational view, a front end view and a top view respectively of a ninth embodiment 90 of the mustache shaving device of the present invention, with an exposed razor blade and a generally square fingertip grip portion having a cross-hatched gripping texture.
FIG. 16D shows an all-metal version 90' of the ninth embodiment which has a razor blade strip attached to one side thereof.
FIGS. 17 is a side elevational view of a tenth embodiment 100 with an exposed blade having a curved edge and a vertically projecting balloon-like fingertip pinch grip portion for enhanced gripping.
FIG. 18 is a perspective view of an eleventh embodiment 110 having front cutter and fingertip grip portions that each have a similar generally rectangular shape, but are arranged at right angles to one another, and having a fully exposed blade with rounded sharpened front and rear corners.
FIGS. 20A and 20B are an exploded perspective view and a front end view, respectively, of a thirteenth embodiment of my mustache shaving system, whose shaving device 130 has a front cutter portion and a fingertip grip portion of generally similar trapezoidal shape, which are arranged in an horizontally offset inverted arrangement.

FIGS. 16B and 16D are two front views of two versions of the FIGS. 16A–16D device which help show just how thin the shaving devices of the present invention may be made if desired. For example, if device 100 is made from plastic, the overall thickness dimension 109 may in a range between about 0.2 mm and about 0.4 mm (or it may be made considerably thicker if desired). Just how thin my shaving devices may be made is a function of the rigidity of the particular materials out of which the device is formed. If less flexible materials, such as rigid metals are employed, then the devices may be less thick. For example, if the body of my device is made out of a flat steel sheet, thickness dimension 109 may be in the range of about 0.4 mm to about 1.0 mm if desired.

FIG. 16A and FIG. 16D, taken together as device 90', show an all-metal construction, which is best understood from FIG. 16D. An all-metal shaving device may have a body stamped out of one piece of metal into any desired essentially flat shape disclosed in this specification. If the blade 96 is to be integral with the body, then the lower edge of the stamped stock will also represent the blade area, which will be in the same plane as the all-steel flat body. The lower edge of the blade area will be sharpened until it is razor sharp. A preferred approach, however, is to use a one-piece metal stamping for the body, and a separately prepared razor blade strip 96 attached thereto as shown in FIG. 16D. The flat stamped metal body may have all of its exposed sharp edges rounded by grinding them or by running the stamped stock through any conventional finishing operation, such as tumbling in an aggregate mix, which knocks off and/or wears down all sharp edges. The separate blade can be made from conventional razor blade metal alloys formed into ribbon-like blade strips that have one finely-sharpened edge which are then cut to length as desired. Such blade strips are usually quite thin (in the range of 0.05 mm to 1.5 mm and usually less than 0.15 mm) and therefore flexible. These very thin blade strips may be made stiffer by attaching each to a more rigid metal support stock by conventional laser welding or by any other suitable bonding technique such as epoxy adhesive drops. A series of such laser welds or drops are shown in FIG. 16A as circles 94.

FIG. 17 shows that device 100 has an elongated thin rectangular head portion 101 and a balloon or tear-drop shaped grip portion 102. Pocket 105 receives flat blade strip 106 whose razor sharp edge 107 may be substantially straight, or may be substantially curved as shown. This curve may take any desired shape. It is preferred that such a curve substantially match the curvatures of the skin to be shaved on a typical user's face, such as those found around the naso labial fold area. For ease of manufacture, the curve may simply be a small part of a larger circle, such as a circle which has diameter one to two times the overall length 108 of blade 106. The distance 104 that the free portion of blade 106 extends may be varied as desired, such as between 0.4 mm and 1.5 mm.

FIG. 18 shows my mustache shaving device 110 which has a cutter head 111 and pinch grip tab 112 that are each rectangular in shape and of equal size. The head 111 and tab 112 form the body of the device 110 and are symmetrically arranged about the central axis A-0 of the body. Although the respective centerlines A-1' and A-2' of portions 111 and 112 are shown arranged at right angles, the angle 103 between these centerlines may be set at any angle anywhere in a range between about 45 degrees to about 120 degrees. The size of the head 111 and tab 112 may also be varied. When the sizes of the head 111 and tab 112 are the same, the central axis A-0 of the body and the axis A-1 and A-2 all intersect at point 104.

Blade 116 has a razor-sharp edge 117 with an elongated straight portion in between two curved portions 118 and 119. These curved portions may be razor sharp or blunted in whole or in part, as desired.

Figure 19:
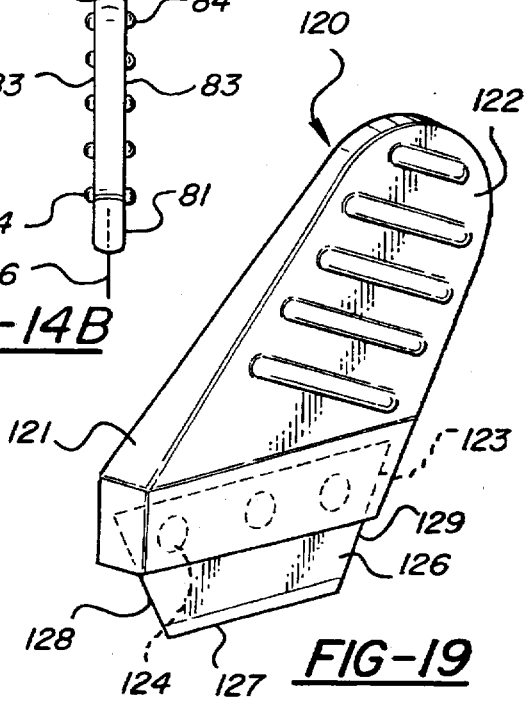
FIG. 19 is a twelfth embodiment 120, similar to the seventh embodiment, but made with a plastic body of flying wedge shape including a fingergrip portion with raised gripping ridges for enhanced gripping and a short fully exposed razor blade.

FIG. 19 shows another mustache shaving device 120 which has a flying wedge appearance. Its body is comprised of a unitary molded piece of plastic which forms the cutter head portion 121 and pinch grip portion 122. The blade 126 has a sharpened edge 127 and inclined leading and trailing edges 128 and 129. Blade 126 also has an upper section 123 provided with a plurality of holes 124 through which plastic material is captured during the molding process, thus permanently interlocking the blade 126 to head 121.

FIGS. 2A–20B show a mustache shaving system 135 formed from a mustache shaving device 130 and a shaving guide attachment 140. The attachment 140, which I sometimes call a steadyrest, has front and rear end portions 141 and 142, that each resemble opposing C-shapes when viewed from above, and a substantially flat side surface 143 having a substantially straight and parallel upper and lower edges 144 and 145. The substantially open area bounded by the inside surfaces of C-shaped end portions 141, 142 and side wall 143 forms a substantially open groove 146 which slides into an engagement upon and is frictionally held upon corresponding end surfaces 147 and 148, as best shown in FIG. 20B.

Figure 20B:
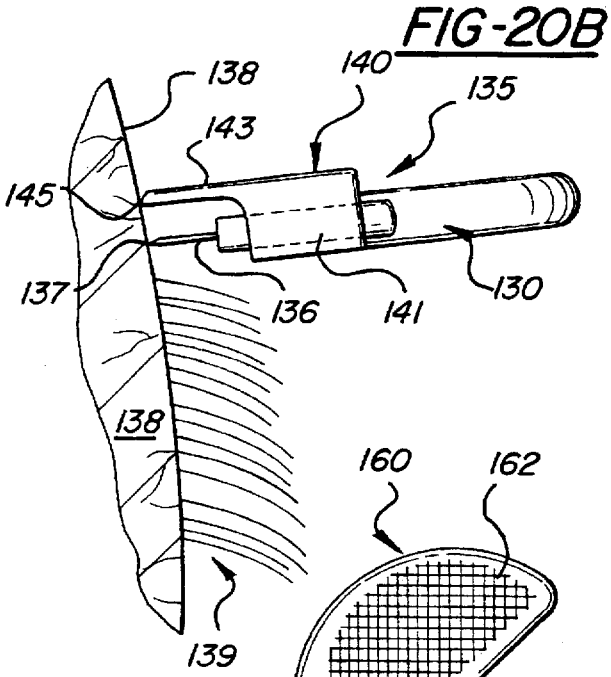

As shown in FIG. 20B, lower edge 145 of installed steadyrest 140 is parallel to and held spaced apart from the sharpened edge 137 of blade 136 of device 130 as the user shaves his skin 138 to shape the edge of his mustache hairs 139. Steadyrest 140 thus provides a shaving guide to help a beginning user of my mustache shaving device 130 judge when razor blade edge 137 is coming into contact with his skin 138. The steadyrest 140 also helps distribute any excess downward force which such the user might inadvertently apply to his skin.

Figure 21A:
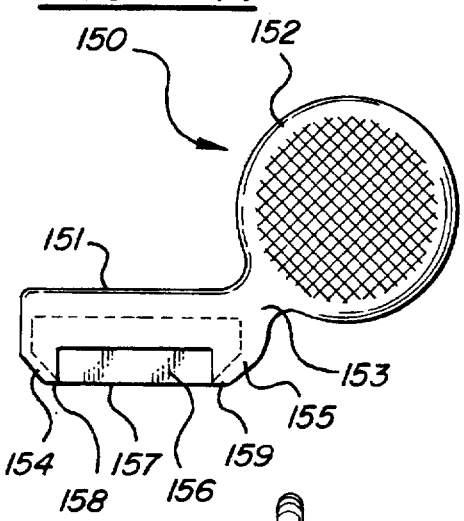
FIGS. 21A, 21B and 21C are a side elevational view, a front end view and a top view respectively of an fourteenth embodiment 150, with a fully guarded razor blade strip and a generally circular fingertip grip portion having an enhanced gripping surface-cross-hatched.
Figure 21B:
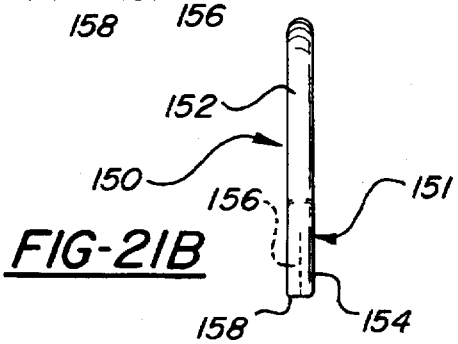
Figure 21C:
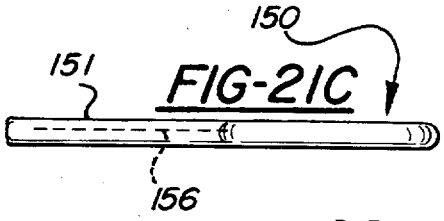

FIG. 21A–21C show three different views of my mustache shaving device 150, which features a generally rectangular head portion 151 and a generally circular pinch grip portion 152 interconnected through an integrally formed neck portion 153, which may be made shorter or longer than shown, if desired. The front and rear corners of razor sharp edge 157 of blade 156 is guarded by front and rear end sections 154 and 155 of head portion 151. The lower tips or edges of the sections 154 and 155 may be sharpened as desired to provide the user with blunted extensions of blade edge 157, and/or better visibility and/or control of the razor edge.

Figure 22A:
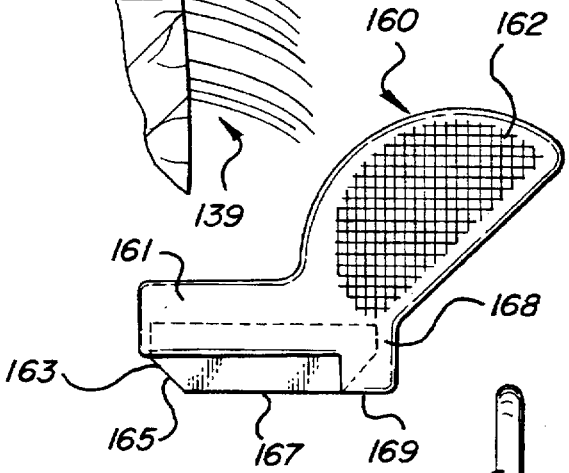
FIGS. 22A, 22B and 22C are a side elevational view, a front end view and a top view respectively of a fifteenth embodiment 160 of my mustache shaving device, with the rear end of the razor blade strip being guarded and having a generally hemispherical fingertip grip portion arranged diagonally relative to the sharpened blade edge.
Figure 22B:
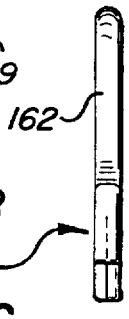
Figure 22C:
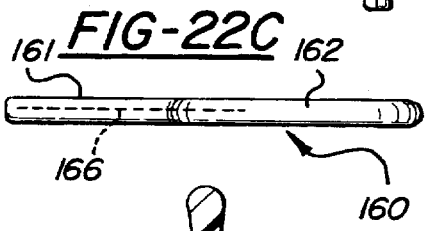

FIG. 22A–22C show my mustache shaving device 160 which has a rectangular head portion 161 and rectangular fingertip pinch tab portion 162. Portion 162 has a major axis inclined at about a 45 degree angle relative to the sharpened blade edge 167. Rear portion 168 of head portion 161 is about 0.4 mm to 0.8 mm long and more readily allows its user to place surface 169 firmly against his skin and then lower razor sharp edge 167 down toward the hair to be cut or skin to be shaved. Front edge 163 is inclined and corner 165 is blunted to minimize any chance of the corner 165 cutting user's skin.

Figure 23A:
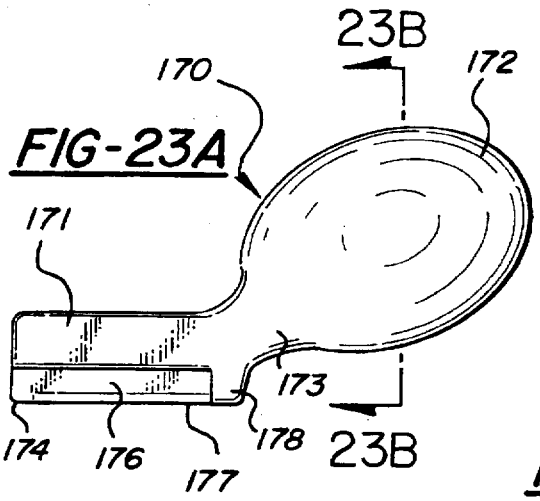
FIGS. 23A and 23B illustrate a sixteenth embodiment 170 which has an oval fingertip grip portion, and a blade strip having a blunted forward end and guarded rear end, with FIG. 23A being a side elevational view, and FIG. 23B being an end cross-sectional view taken along line 23B—23B of FIG. 23A showing another enhanced gripping design for the pinch grip portion which has a shallow concave profile.
Figure 23B:
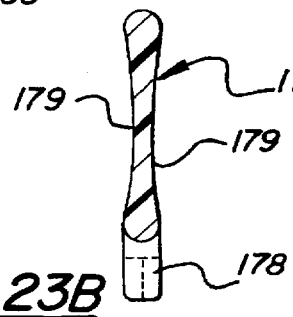

FIG. 23A–23B show my shaving device 170 which has an elongated head portion 171 and an oval pinch-grip portion 172 interconnected by a thick neck section 173. Portions 171 through 173 all lie in the same plane. The blade 176 has a rounded blunt front end 174. Rear section 178 of head 171 is similar to but shorter than section 178 in FIG. 22. FIG. 23B is a cross-sectional view showing that the side surfaces 179 of pinch-grip portion 172 is slightly concave, thus providing an enhanced gripping action.

FIGS. 24–24E show a seventeenth embodiment of the shaving device of my invention. This device 180 has an assembled head or cutter portion 181 and a thicker pinch-grip portion 182. Head portion 181 has front and rear blade guard portions 183 and 184 and a blade pocket 185 located therebetween. Blade 186 has a straight elongated sharpened edge portion 187 and three locating holes 165 through which registration pins 189 pass. The blade 186 fits snugly within the corresponding walls of pocket 185, and interior side surface 196 of pocket 185 snugly engages the corresponding side surface of blade 186. Blade 186, once installed upon pins 189 into pocket 185, is kept there by blade cap 190. Cap 190 is interlocked in place by pins 189 which enter corresponding locating holes in the cap. Cap 190 also fits snugly into its own pocket, as will now be explained.

Head portion 181 includes a further outer shallow pocket 191 with curved surfaces 193 and 194 that engage exterior edges of front and rear sections 195 and 196 of cap 190. Head 181 has four more registration pins 198 that engage corresponding holes 199 of cap 190.

Pinch-grip portion 182 has a generally rectangular side profile with rounded edges, and features slightly concave side surfaces 203, which can best be seen in FIGS. 24B and 24E, for enhanced gripping action. The average radius of each concave surface 203 is preferably in the range of 1.5 cm to 4.0 cm. Transverse thickness dimensions 205, 206 and 207 may be adjusted if desired to provide concave surfaces which generally conform to the curvature of a typical user's finger and thumb in both horizontal and vertical directions as best shown in FIGS. 24B and 24E.

FIG. 24C shows an enlarged side fragmentary view of the front end portion of cutter head 181 in an assembled state. As shown therein, its blade 186' may have its sharpened edge 187 blunted at location 207 in the vicinity of front end section 183.

FIG. 24D shows in cross-section the end profile of the cutter head portion 181, and how it tapers inwardly so that its midpoint dimension 208 is less than its upper dimension 209. Further, lower end section 213 of front 183 may be more sharply tapered, for example, by curved concave surfaces 211 and 212 as shown in FIG. 24D. This sharp tapering of section 213 is preferably repeated at lower section 214 of rear area 184 shown in FIG. 24A. This tapered arrangement at locations 213 and 214 is believed beneficial since it allows their lower edges 215 and 216 to act as front and rear blunted edge extensions of the sharpened blade edge. As earlier noted, less skilled users may wish to press a blunted edge against his skin for alignment purposes, without fear of cutting or scratching his skin, in order to get a precise feel for where the razor is before he begins cutting and/or shaving facial hair along the periphery of his mustache. Further, this overall tapered design, especially the sharply tapered lower end sections 213 and 214, also helps maximize the user's view of the razor area even when upper dimension 209 is relatively thick.

Figure 25B:
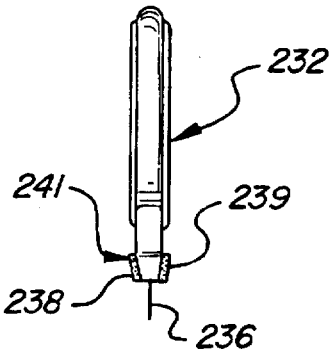
Figure 25C:
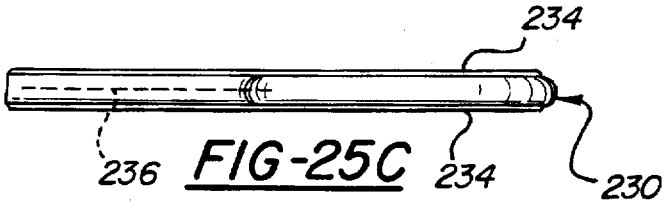
Figure 26A:
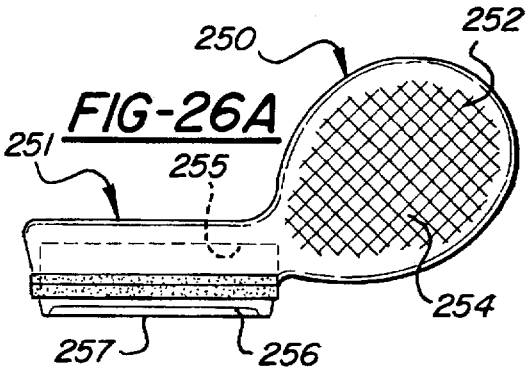
Figure 26B:
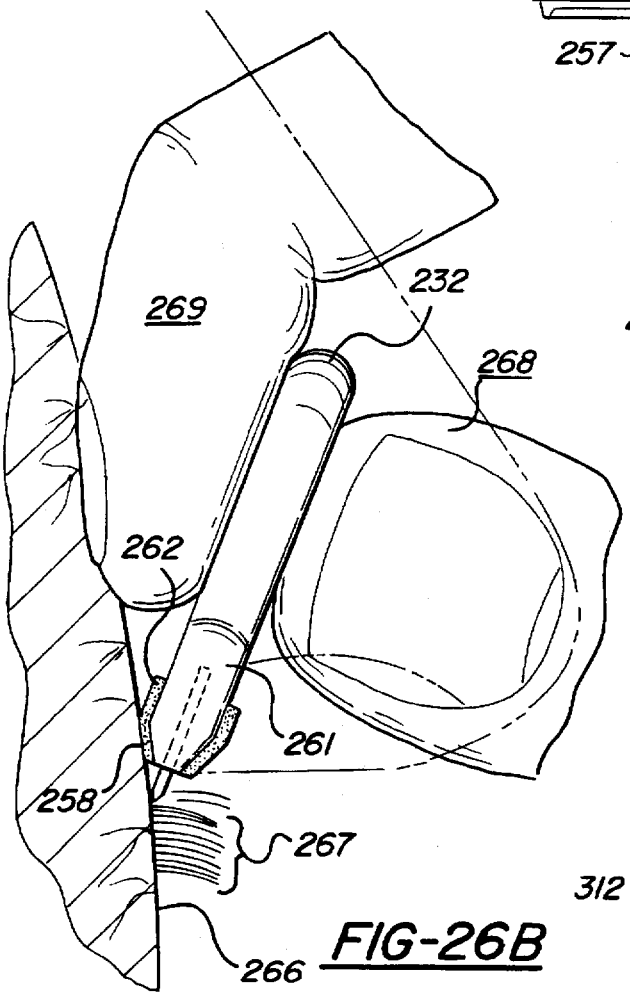
FIG. 26B shows an enlarged front end view showing the pinch grip tab portion being pinched between a user's thumb and forefinger with the lubricated strip positioned against a user's face to shave the edge of his mustache.
Figure 26C:
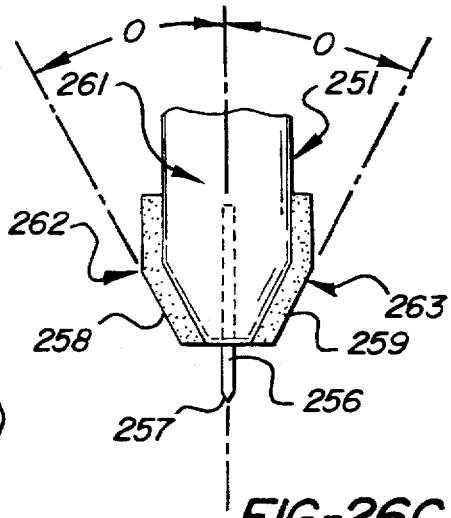
FIG. 26C shows an enlarged partial fragmentary front end view detailing the geometry of the glide strips in relation to the cutting blade.

FIGS. 25A–25C and 26A–26C show two mustache shaving devices 230 and 250 which utilize very smooth glide surfaces located a short distance from the razor blade edge on the lower part of the cutter head portion. These glide surfaces help provide controlled facial hair cutting at a predetermined acute blade angle, as best illustrated in FIGS. 26B and 26C. FIG. 26B is an enlarged view which shows a device 250 being gripped by user's forefinger and thumb in order to shave his mustache hairs, with a profile of his nose shown in phantom to make the view more readily understood.

Device 230 in FIGS. 25A–25C includes a generally rectangular cutter portion 231, an oval pinch grip portion 232, and an intermediate portion 233 interconnecting portions 231 and 232. All three portions lie in a common plane. The side surfaces of tab portion 232 includes a series of oval raised ridges 234 for enhanced gripping action. Interior channel 235 in head portion 231 receives blade strip 236, which has a razor sharp edge 237. Angled glide surfaces 238 and 239 that are inclined at a desired acute angle relative to the common plane of device 230 are provided on the lower section 241 of head 231. Glide surfaces 238 and 239 may be integrally molded as part of the head section 231 or may be formed by separate elongated strips attached by a suitable fastener, such as adhesive or sonic welding to the lower section 241 of head 231. The planes defined by angled glide surfaces 238 and 239 preferably intersect at razor sharp edge 237 of blade 236, in way that is shown in for device 250 in FIG. 26C.

FIG. 26A shows that shaving device 250 has a cutter head 251 and paddle-like pinch grip portion 252 provided with cross-hatched lines 254 (which may be shallow grooves or tiny raised ridges) to enhance gripping action. As in FIGS. 25A–25C a pocket 255 receives blade 256 which has a straight razor sharp edge 257 with blunted forward and rear corners. As best shown in FIG. 26C, the lower section 261 of head 251 is provided with lubricated emollient glide strips 262 and 263 which have flat angled surfaces 256 and 259 which define glide planes that point intersect one another at edge 257 of blade 256. These glide planes are symmetrically arranged about the common plane and centerline 265 of device 250 at predetermined angle $\phi$, which normally will be in the range of about 5 to 40 degrees, with angles in the range of 15 to 35 degrees being presently preferred.

Glide strips 262 and 263 each preferably include a solid water-soluble shaving assistance material that can also provide lubrication, whisker softening, razor cleaning, medicinal agents, cosmetic agents or a combination of the above as a part of the mustache shaving device. Such shaving aid strips are known in the art of modern manual shaving razors and often include one or more of these components, which are conventionally embedded in and formed as part of a glide strip typically affixed to a conventional T-bar razor somewhere in the working plane of the razor, often behind the razor sharp cutting edge. The shaving aid strip may be a shave-aiding agent combined with a solid, water-soluble micro-encapsulating or micro-porous structure which retains the agent. The strip can be the agent itself when it is a water-soluble solid. Exemplary materials constituting shaving aid strips are described in U.S. Pat. No. 4,170,821 to Booth, which is hereby incorporated by reference.

FIG. 26B shows how the inclined surface 258 of lubricant strip 262 can be slid along the plane of skin 266 in the vicinity of mustache hairs 267 to provide controlled and very safe and easy cutting action in angle $\phi$. FIG. 26B also helps illustrate the typical size of a pinch grip tab portion, such as portion 232 relative to the fingertips of a user's thumb 268 and index finger 269. It also shows, in combination with FIGS. 13 and 15 that slightly different fingertip gripping styles may be employed by a user on the pinch grip tab as he manipulates the typical one of my mustache shaving devices about all sides of his mustache.

FIGS. 27A–27B, 28A–28B and 29A–29C show three embodiments of the mustache shaving devices of the present invention which feature substantially exposed yet guarded blades. These embodiments also illustrate that the mustache shaving devices of the present invention which are symmetrical about the center plane may be made from two substantially similar half-pieces whose exterior surfaces are substantially mirror images of one another. The shaving guard in each embodiment is characterized by a plurality of finger portions extending from the head portion of the instrument that extend below the lowest portions of the sharpened razor blade edge. Thus, each of these finger-like shaving guards place a plurality of short blunted plastic or metal edges between at least a portion of the skin to be shaved and the razor blade edge. This provides further insurance against accidental nicks or cuts which might be produced which a razor-sharp blade edge is pressed against the relatively soft and tender facial skin adjacent to the mustache. These substantially exposed yet guarded blade designs are thus expected to be popular with those who feel uncomfortable with placing an unguarded entirely exposed length of razor sharp steel against their skin. Since the razor sharp edges of FIGS. 27A–29B, 28A–28B and 29A–29C are still substantially exposed, and can easily be moved in any desired direction, such designs will easily cut all of the unwanted facial hair from any region of skin around the user's styled mustache in one or more fingertip strokes of the device against the skin in a direction transverse and preferably perpendicular to the blade plane. Each of the three devices with a shaving guard will now be described in detail.

Figure 27A:
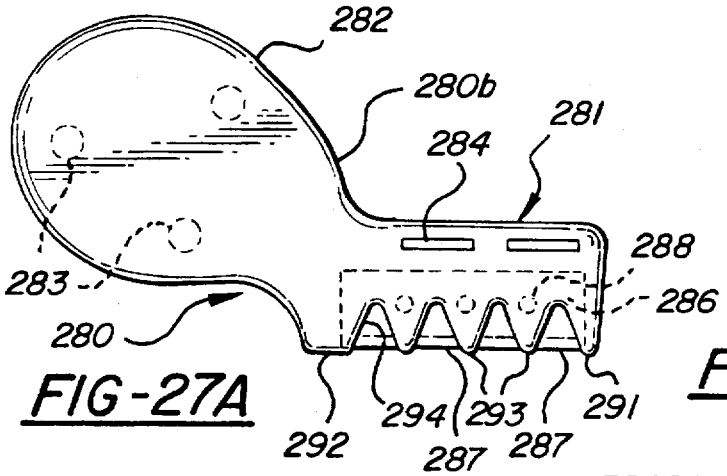
Figure 27B:
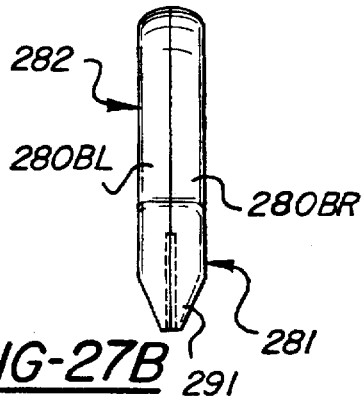

The FIG. 27A shaving device 280 includes a body 280B made from two half-body sections each forming one-half of head portion 281 and pinch grip tab portion 282 of device 280. The left and right half body pieces 280BL and 280BR are best seen in FIG. 27B. Mating registration pins and holes represented by dotted circles 283 and mating slots and raised locking strips represented by rectangles 284 are used to join and interlock the two half-body pieces 280BL and 280BR together. Blade strip 286 includes razor edge 287 and holes 288 which receive registration pins. The internal construction of the of device FIGS. 27A and 27B may be similar to that shown in device 180 shown in FIG. 24A in that a channel complementary to blade 286 can be provided internally within the half-body parts 280BL and 280BR. Head portion 281 has front and rear end sections 291 and 292 and a plurality of intermediate finger sections 293 which are preferably spaced equally from one another and preferably leave about 60 to about 90 percent of the sharpened blade edge 87 exposed in the four notched regions 294 between the end sections and fingers. The guarding distance between the lowest portion of the end sections 291,292 and fingers 293 may be in the range of 0.4 mm to about 1.2 mm, with a guarding distance in the range of 0.5 mm or less being presently preferred.

Figure 28A:
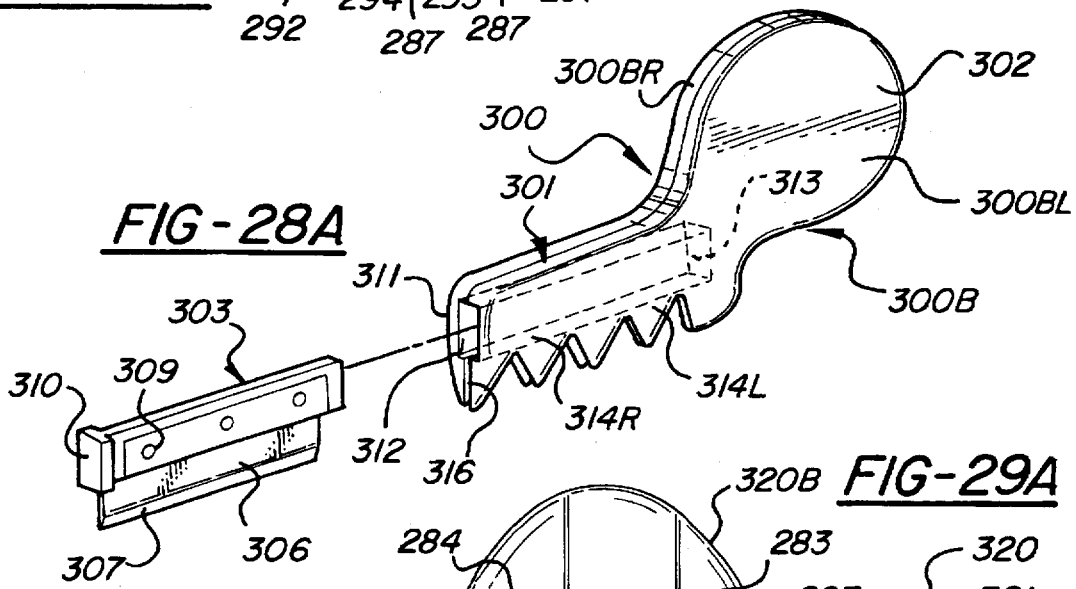
Figure 28B:
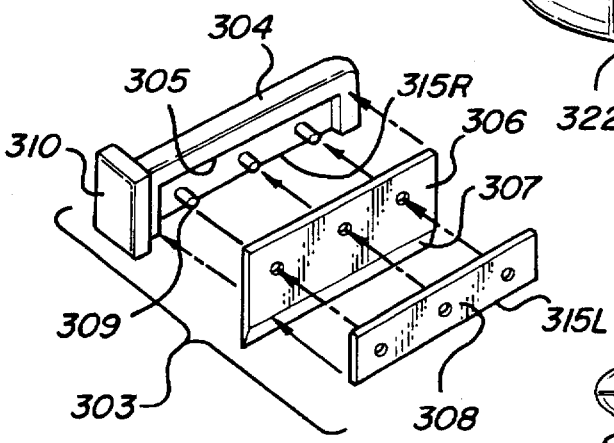

FIGS. 28A–28B show, in a perspective view, a variation of my FIGS. 27A–27B design, a shaving device 300 that includes a removable, replaceable blade cartridge. Those details of the device of FIGS. 28A–28B that or can be made the same as the FIGS. 27A–27B device will not be described, Instead, the description below focuses on the arrangements for blade cartridge. Device 300 includes a head portion 301 arranged to receive a blade cartridge and an integral finger grip portion 302, which together form body 300B. As in FIGS. 27A–27B the body may consist of two half sections 300BL and 300BR, each with external appearance that is the mirror image of the other. Device 300 also includes blade cartridge 303, which preferably is assembled, but may include a molded or die cast blade and cartridge if desired. The assembled blade cartridge, as best shown in exploded perspective view of FIG. 28B, includes a platform section 304 having an internal opening or channel 305 formed therein with whose front, rear and top surfaces correspond to the shape of and snugly engage corresponding surfaces of separate metal alloy blade 306 having razor sharp edge 307. A blade cap member 308 completes cartridge assembly 303 by engaging registration pins 309. Platform member 304 has an enlarged rectangular front end section 310 which abuts against the front end section 311 of head portion 301 when cartridge 303 is inserted in the rectangular opening 312 to an internal rectangular chamber 313 shown in dotted lines in head 303. Chamber 313 has two lower surfaces 314L and 314R which slidingly receive corresponding lower surfaces 315L and 315R respectively found on platform 304 and cap 308. Thin elongated slot 316 in head 301 extends between surfaces 314L and 314R, and is sized to snugly receive and frictionally grip the unsharpened lower side surfaces of blade 306 above sharpened edge 307, thus helping hold cartridge 303 securely in place within chamber 313 where it snugly fits on all sides. An optional mechanical latch arrangement (not shown) may also be provided to interlock inserted cartridge 303 into head portion 301 if desired.

One advantage of the mustache shaving system represented in FIGS. 27A–27B is that cartridge 303 may be repeatedly replaced whenever blade 306 is spent, thus allowing the body 300B of device 300 is reused again and again. Like with traditional manual razor systems having a cartridge, this replaceable cartridge feature may appeal to those who wish to have a premium grade expensive or styled body 300B, which might even made out or plated with a precious metal alloy, while the least expensive and most easily worn part namely the blade, is readily handled in a convenient cartridge and replaced as frequently needed or desired. In this regard, replacement cartridges may be sold be the six-pack or ten pack, just like disposable replacement razor blade cartridges for conventional T-bar razors are. If my mustache shaving devices become popular with barbers, then replacing the cartridge and blade for each new customer may also become desirable for health and safety reasons. Further, my blade cartridges can be made to withstand sterilizing medicinal solutions or even autoclave temperatures if desired by selecting proper materials for the cartridge assembly 303 such as but not limited to stainless steel or other metal alloys. Alternately, in a manner similar to the Schick injector series of cartridge razors, suitable cartridge blade dispensing devices may be developed and utilized, based upon the principles explained herein, to provide replacement of only the razor blade strip in the replaceable blade mustache shaving devices of the present invention.

Figure 29C:
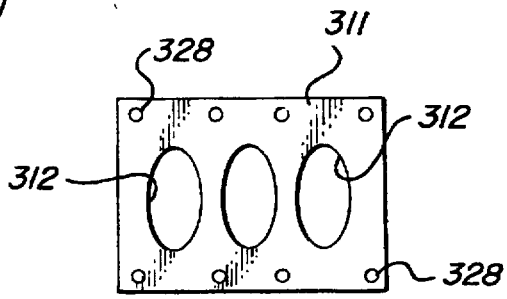
FIGS. 27A–27B, 28A–28B and 29A–29C show three more mustache shaving devices of the present invention, which each have a guarded, but substantially exposed sharpened blade edge, where.
Figure 29A:
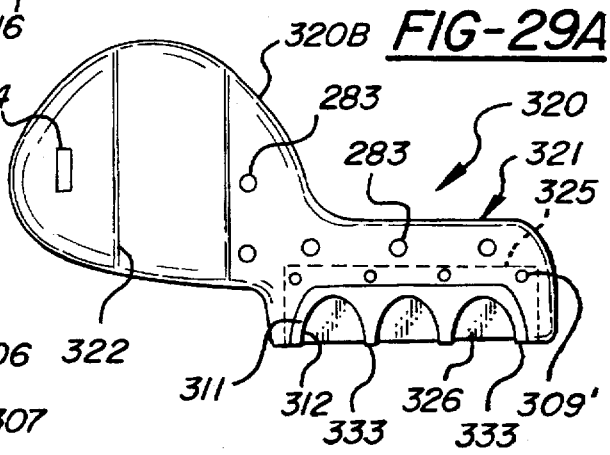
Figure 29B:
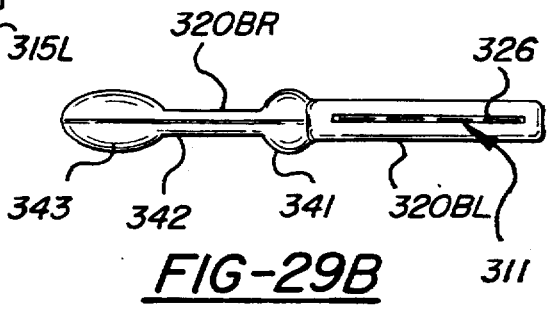

FIG. 29A–29C show a third substantially exposed yet guarded blade shaving device 320 which is essentially identical in overall construction to device 280 shown in FIGS. 27A–27B except that the head section includes a thin metal sheath which serves to form a plurality of protective fingers as will shortly be described. Device 320 includes a body 320B consisting of left and right half body parts 320BL and 320BR. Assembled body 320B has a head portion 321 and finger grip portion 322, with the half parts interlocked by complementary slots and rails and pins and holes 284 and 283. A pocket 325 within head portion 321 receives blade 326 which has holes for receiving interlocking registration pins 309' that project out one of the half body parts into corresponding holes of the other half body part of body 320B.

As shown in FIG. 29C, sheath guard 311 is formed from a thin flat rectangular sheet of metal that is first perforated with three large oval holes 312 and punched with two sets of four smaller locating holes 328. As shown in FIG. 29D, the metal sheet is then folded in half and wrapped around the blade 326 before blade 326 is assembled into body 320B.

The two sets of smaller holes 328 are in the same location as registration pins 309' so that the same registration pins which interlock blade 326 in place also capture and hold the guard 311 in place. This general technique of using a metal sheath to form a shaving guard for a razor blade strip on a conventional T-bar razor is shown in U.S. Pat. No. 3,263,330 to Ferrara, the disclosure of which is hereby incorporated by reference. Sheath guard 311 may be formed of any suitable material including fiber-reinforced plastic materials or stainless steel strip stock, and may have any suitable thickness, for example in the range of 0.05 mm to 0.15 mm.

FIG. 29B shows a bottom view of device 320. Like the FIGS. 27A–27B device, the four fingers 333 of the sheath guard 311 preferably leave about 60 to 90 percent of the sharpened edge of blade 326 exposed, and the lowest part of fingers 333 preferably extend below razor edge 327 by a distance in the range of 0.10 mm to about 0.3 mm.

FIGS. 29A and 29B show that body portion 322 of shaving device 320 may have a thickened front and rear portions 341 and 343 with a thin center portion 342 in between. Thicker portions 341 and 343 thus define opposed vertically arranged ridges which define a vertical trough in between, and provide a complex concave surface that enhances user gripping action. Further, such pronounced surface features also are believed to provide users with a good tactile feel to help enhance their sense of confidence in using my shaving instruments.

Figure 30A:
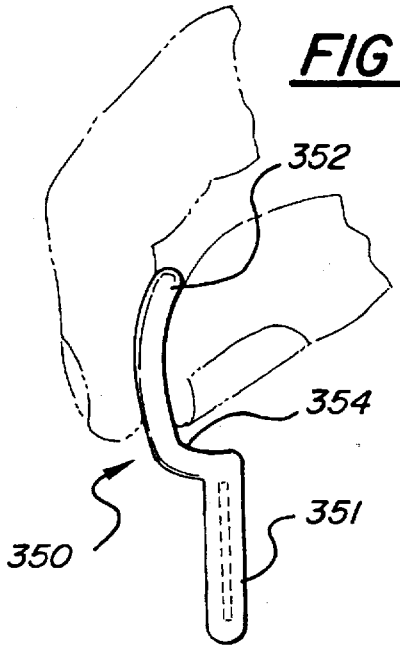
FIGS. 30A–30C show five views of the twenty-third embodiment 350 of my shaving device, with FIGS. 30A, 30B, 30C and 30D respectively being a top view, front perspective view, side elevational view, slightly enlarged rear end view, and enlarged cross-sectional end view, where.

FIG. 30A–31E show my shaving device 350 which has a compound offset between its cutter portion 351 and pinch grip portion 352. This offset is provided by intermediate transverse section 353 that is substantially orthogonal to the plane of the blade 356 provided in head portion 351. FIG. 30A shows that the rear side of interconnecting portion 353 forms a pocket 354 into which the user's thumb tip may fit, thus enhancing the user's grip and sense of security in handling this instrument.

Figure 30B:
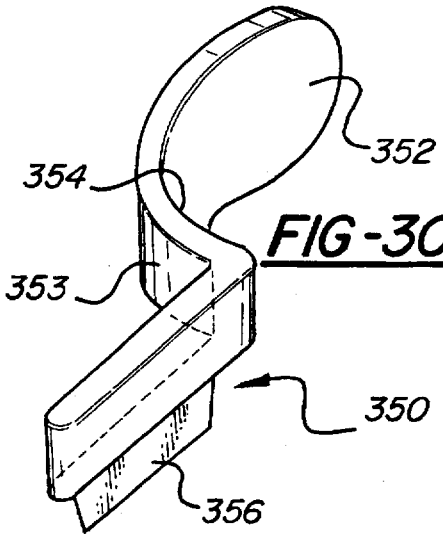
Figure 30D:
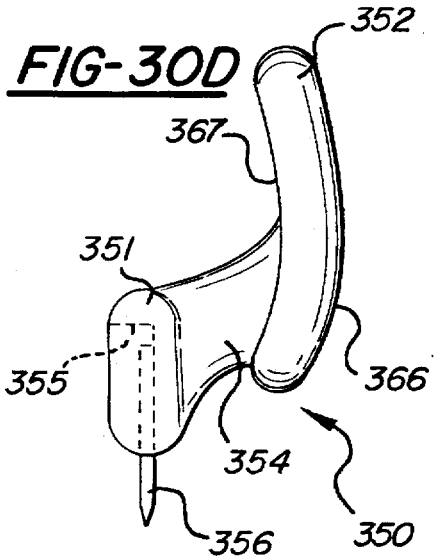
FIG. 30D shows the curved surfaces of the pinch grip tab portion.
Figure 30C:
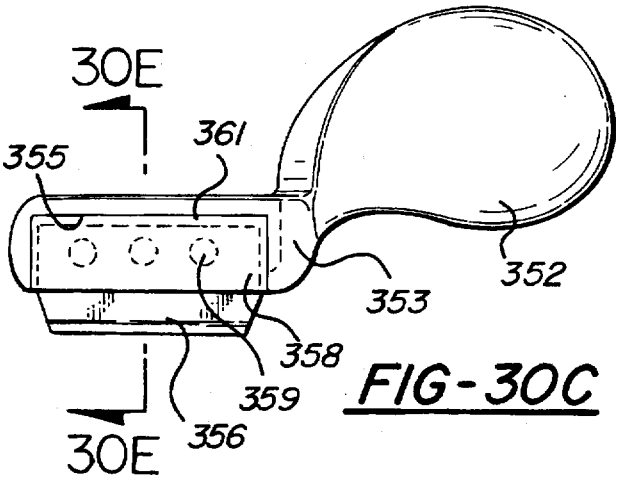

FIGS. 30A–30C show that pinch grip portion 352 has its major axis horizontally arranged above the major axis A-1 of head portion 351. Minor axis or centerline A-3 have been strip portion 352 is substantially displaced rearwardly of the minor axis and vertical centerline A-5 of head section portion 351.

Figure 30E:
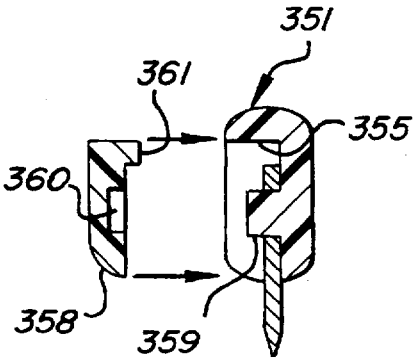
FIG. 30E shows a cross-sectional view of the head portion with the blade installed and blade cap removed.

FIG. 30C and 30E show that head portion 351 may be an assembled structure including a pocket 355 which receives the blade 356 and cap member 358. Blade 356 has three holes which snugly fit over registration pins 359, and cap member 358 includes a blind registration hole 360 that engages the remaining free tip of registration pin 359. Elongated lip 361 of cap 358 fits into a corresponding corner part of pocket 355 above the blade.

As best shown in FIG. 30D, pinch grip tab 352 includes convex surface 366 and opposing concave surface 367 which together provide an enhanced gripping action and improved tactile feel for a user of instrument 350.

FIG. 31A–31E show an assembled shaving device 370, whose body 370B has a peanut-shaped side profile and is preferably formed of two fully-identical half-body pieces 370BL and 370BR. Assemble device 370 includes a blade holding head portion 371 and a pinch grip portion 372. Blade-receiving pocket 375 is formed in front portion 371. A second blade receiving pocket 378, that remains unused, is formed in the pinch grip portion 372 as a result of having two identical haft body parts 370BL and 370BR.

Blade 376 assembled in chamber 375 located between body parts 370BL and 370BR. Complementary press-fit registration pins and holes 381–386 are provided as shown to interlock the two half-body parts together. If desired, this interlocking may be permanent by a cold-headed press fit or by sonically welding portions of the pins and holes together. Alternatively, the interlocking of body parts may be relatively loose, so that they can be readily pried apart by inserting a stiff knife blade into empty pocket 378 and twisting, and thus allowing a spent or dull blade 376 to be removed and a replacement blade 376 to be inserted. Because my mustache shaving devices of the present invention, particularly this device 370, are very inexpensive to manufacture, I prefer that the entire unit be disposed of rather than using replacement blades requiring disassembly of the device body.

Figure 31A:
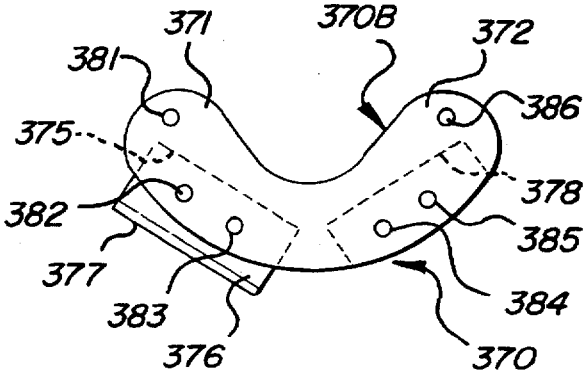
FIGS. 31A–31E show a twenty-fourth embodiment 370 of the mustache shaving device of the present invention having a body with a peanut-side profile, made of two identical half-shell pieces, whose exteriors are each symmetrical about the transverse centerline, and a straight blade strip, where.
Figure 31B:
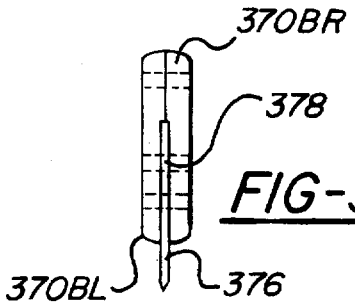
Figure 31C:
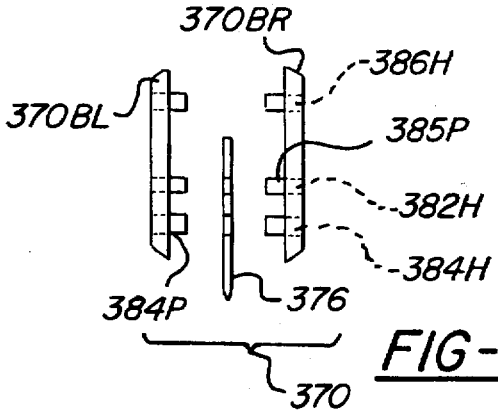
Figure 31D:
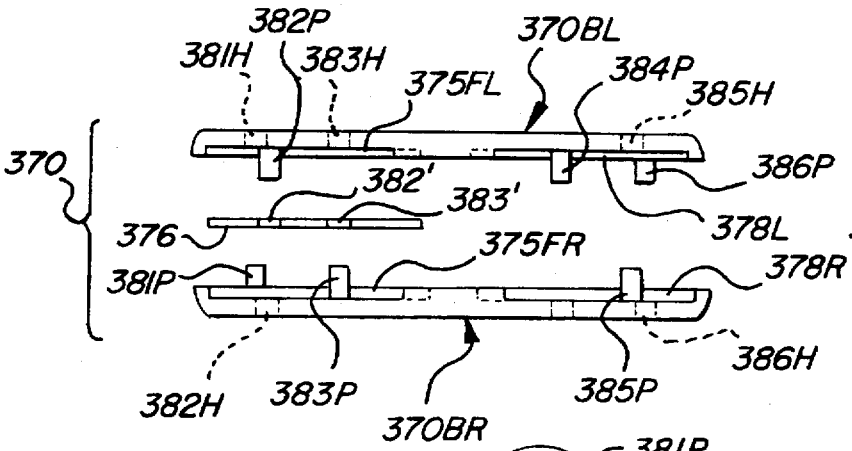
Figure 31E:
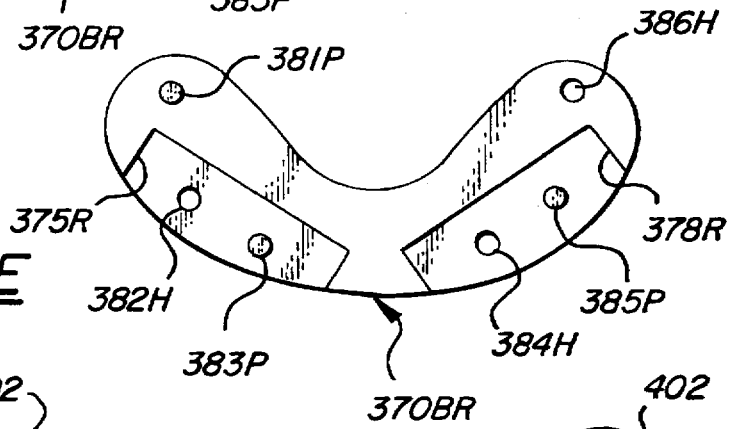

FIGS. 31B and 31C show a right end views of device 370 in assembled and unassembled states. FIG. 31 D shows device 370 from a bottom view in its unassembled state, with the half parts 370BL and 370BR aligned with one another and the razor blade 376, ready for assembly. Razor blade 376 includes holes 382' and 383' through which pins 382P and 383P will project to help lock blade 376 in place. Registration pin 382P on part 370BR is received in hole 382H in part 370BL. In a similar fashion, registration hole 383H in part 370BR receives pin 383P in part 370BL. This scheme of suffixes "P" and "H" also show how pins and holes 383 through 386 interconnect.

The use of identical half-body parts 370BL and 370BR in device 370 is believed to help reduce manufacturing costs and simplify assembly, since only one body part needs to be made. Although body 370B has a peanut shape, those in the art will appreciate that other body shapes for mustache shaving devices could well have symmetrical half body parts. One such example is the body part shown in FIG. 18.

Figure 32:
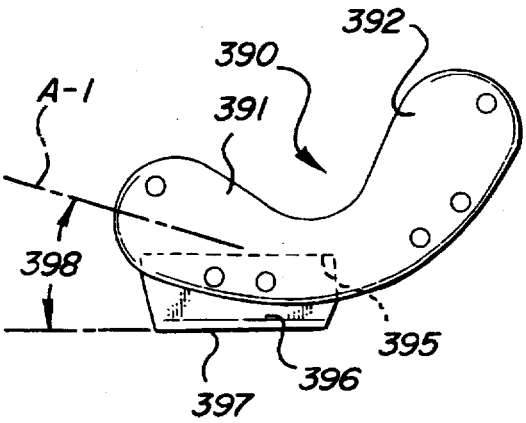
FIG. 32 shows a twenty-fifth embodiment 390 with a peanut-shaped body, whose centerline of its cutter head portion is arranged at a substantial angle from the sharpened edge of the blade.
Figure 33:
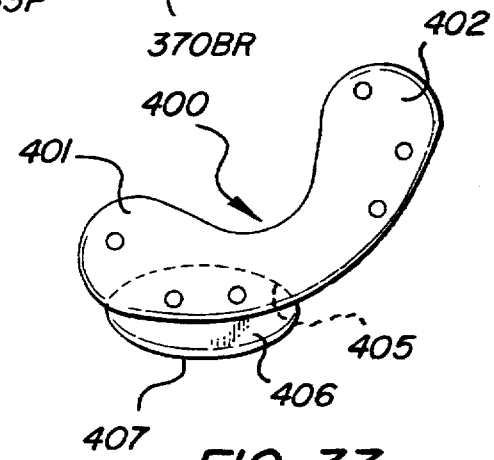
FIG. 33 is a twenty-sixth embodiment 400, having a peanut-shaped body like in FIG. 31, but having a blade strip with a curved sharpened edge.

FIGS. 32 and 33 show my mustache devices 390 and 400 which also have peanut-shaped side profiles and may be manufactured using the identical half body part shown and described for the FIG. 31 device. Device 390 in FIG. 32 has a head portion 391 and finger grip portion 392, and an internal pocket 395 receiving blade 396. Razor sharp edge 397 of blade 396 is at an angle 398 with respect to the major axis and centerline of head portion 391. This illustrates that centerline of the head portion and the straight edge of a blade carried thereby need not be parallel to one another. In FIG. 33, device 400 has a peanut-shape body with head portion 401 and pinch grip portion 402, and an oval pocket 405 for receiving blade 406 which has corresponding generally oval shape and an arcuate sharpened edge 407. Device illustrates that curved as well as straight blades may be utilized in and offset from the longitudinal axis of the head portion of my mustache shaving devices if desired.

FIGS. 34A–34E show another assembled mustache shaving device 410 which features a floating razor blade and openings through the head around the blade. These openings allow any debris which may be caught within the blade pocket to be flushed therefrom, either by blowing air or running water through these openings.

FIGS. 34A and 34C in combination show the overall shape of device 410, which has a generally rectangular head portion 411 and pinch grip portion 412. The body 410B is formed into interlocking half pieces 410BL and 410BR, which each contain one half of the head portion and pinch grip portion. Body half piece 410BR, for example, includes head part 411R and pinch grip part 412R in FIG. 34C.

Device 410 includes a pocket 415 in head 411 that receives razor blade 416 whose razor sharp edge 417 protrudes from beneath the lower end of head 411 by a distance 418. There is a gap 419 above the top edge of razor blade within the pocket 415 in which the razor blade may move. A metal or plastic spring 420 with flexible fingers 420F and 420R biases the springs downwardly until the upper ends of oval holes 422 and 424 contact through retaining pins 426 and 428, thus stopping the downward travel of blade 416.

Spring 420 has a central section 420C resembling an inverted W which is captured between upper and lower blocks 425U and 425L. On either side of central block 425 in head 411 are openings 427 and 429 which open into a chamber 415 so that debris within the chamber may be flushed out or blown out.

As best shown in FIG. 34B, pins 431P through 435P from body part 410BR are provided to interconnect the two body halves and are received in corresponding holes 431H through 435P in left half body part 410BL. Those in the art will appreciate that these pins may be made integral with one of the body parts or may be separate plastic or pins forcibly inserted at the time of assembly of device 410.

As shown in FIGS. 34B–34E, raised opposed surfaces 436L and 436R are provided about pin 426. Similarly, raised opposed surfaces 438L and 438R are provided around pin 428. These raised surfaces 436 and 438 are flat and parallel to one another and provide the opposed sets of flat smooth bearing surfaces against which adjacent surfaces around oval holes 422 and 424 of blade 416 may slide. Since the total contact area between the blade 416 and these bearing surfaces is not that great, blade friction is reduced. In addition, the extra clearance provided by raising surfaces 436 and 438 away from the larger outer walls of the chamber 415 provides a larger pathway through which debris, such as cut hair or shaving lather, may be readily flushed.

FIG. 34E shows how blade 416 is able to float against and adapt to the changing topography or surface 440 of a user's skin 442. Further, it shows how lower rear surface 444 of head portion 411 essentially takes the brunt of the user's downward forces through the head against the skin, while the rear end 446 of blade 416 floats up as needed against a light biasing force provided spring finger 420R, while spring finger 420F keeps front portion 446F of the blade 416 down against the user's skin. Accordingly, it should be appreciated by those skilled in the art that the floating blade structure and design of mustache device 410 provide further protection against a user accidentally cutting himself by inadvertently pressing down too hard while shaving unwanted facial hair from around his mustache.

FIG. 35A shows a combined cover guard and trimming accessory 460 of the present invention designed to fit on the head portion of my mustache shaving devices. Trimming guard or cage 460 is symmetrical about its longitudinal vertical plane. This accessory guard 460, and similar but asymmetrical trimming guard or cage 460' shown in FIG. 35B', are each designed to enable mustache hair to be trimmed to different lengths as desired. The precise length cut obtained will be explained in FIG. 35B relative to dimensions 461,462 and 463, which are all measured from the razor sharp edge 17 of blade 16, as will shortly be explained.

FIGS. 35A–35B show that the accessory guard structure 460 has an elongated generally hollow body with an elongated chamber 465 open at ends 466 and 467 guard 460. Upper openings 468 and 469 ensure that structure 460 can fit as far as necessary onto head portion 11 of device 10 without interference from the front 472 of pinch grip tab portion 12. An elongated groove 476 is provided in chamber 465 for receiving the lower portion of blade 16. A series of transverse slots 474 are provided in the lower half of structure 460, thus defining loop-like fingers 475 through which mustache hair may pass and be trimmed by the razor sharp edge 17 of blade 16 when the trimming accessory 460 is in use. The width and number of slots and fingers 474 and 475 may be varied as desired to enable the hair of the mustache to flow easily through the slots while maintaining an even height of cut. A few passes may be required to cut all of the mustache hair to a desired length. As shown in FIG. 35A, the structure 460 may be symmetrical about it elongated vertical plane. Alternatively, the structure 460 may be made asymmetrical, as indicated by structure 460' in FIG. 35B, so that different cutting heights may more easily be achieved.

In operation, after trimming guard cage 460 or 460' has been slid onto head 11 of mustache shaving device 10, a user then places the lower end portion 480 of structure 460 or 460' against his skin adjacent to his mustache. Then, with a transverse sweeping motion preferably perpendicular to the blade edge, the lower portion 480 is slid along the user's skin so that the mustache hairs pass through slots 474, thus allowing the razor sharp edge 17 to trim the hair to a uniform length above the skin. If the user holds device 10 such that the lowermost portion 482 of lower section 480 slides along the skin, a precise length of cut equal to dimension 462 will be obtained. If the user rotates the device 10 and guard with its attached guard 460 so that the surface 481 (i.e., the surface area of lower section 480 that is tangent to the plane defined by line 481 P) is slid across the skin, then the mustache hairs will be trimmed by razor sharp edge 17 to a length equal to dimension 461. Likewise, if a user rotates the combined device 10 and structure 460 so that the surface 483 (i.e., the surface area of lower section 480 that is tangent to the plane line 463P) is slid along the skin, then mustache hair will be cut to a height equal to dimension 463. Further, the user, by rotating the structure 460 in between these various points in between or beyond these various points, 481–483, can obtain additional desired lengths of cut for trimming his mustache hair. Trimming guard 480 shown in FIG. 35A works in a similar manner. Thus, trimming guards 460 and 460' are well suited to further assist the user in trimming up his mustache to a preferred precision style. In addition, each of the guards 460 and 460' if left on the head portion of the shaving device, acts as a safety cover for the razor sharp edge of the shaving device when the device is not in use.

FIGS. 36A and 36B show another combined cover guard and trimming accessory, namely guard cage 490 of the present invention, which is adjustable, and is designed to fit on a specially modified head portion 501 of most any one of my mustache shaving devices, which can have a pinch grip tab 502 of any desired shape. The trimming guard or cage 490 is similar in many ways to cage guard 460, and thus only the significant differences will be noted here. Guard 490 has a lower portion 491 and two extending legs 492 and 493 forming a chamber 495 therebetween. The upper ends of legs 492 and 493 have inwardly facing wedge portions 497 and 498, which form or define a narrow channel 496 therebetween, that represents the topmost part of chamber 495. The width of chamber 495 is slightly greater than the average transverse thickness of head 501, while the width of channel 496 is sized to be somewhat smaller than the average thickness of head 501.

Wedge portions 497 and 498 are designed to frictionally engage one of the four sets of grooves 508A thru 508D and 509A thru 509D formed in opposite sides 503 and 504 of head 501. Each set of grooves 508 is positioned across from one another in a corresponding one of the grooves 509, and each extend longitudinally along opposite sides of head 501.

Adjacent sets of grooves 508 and 509 are spaced apart at fixed distances, in the range of about 1 mm to about 3 mm apart, and preferably approximately 2 mm apart. Although FIGS. 36A and 36B show four grooves 508A-D and 509A-D, more or fewer grooves could be used with varying distances therebetween if desired without departing from the concept presented here. Elongated spacer ribs 512 and 513 extend outwardly from opposite sides of lower portion 514 of the head 501 and provide lateral support for the structure 490 which keeps legs 492 and 493 parallel to the outer sides 503 and 504 of head 501.

A series of transverse slots 494 are provided in the lower half of structure 490, thus defining comb-like fingers 499 through which mustache hair may pass and be trimmed by the razor sharp edge 17 of blade 16 when the trimming accessory is in use. As with guard cage 460, the width and number of slots and fingers 494 and 499 may be varied as desired to enable the hair of the mustache to flow easily through the slots while maintaining an even height of cut, which may require a few passes to achieve.

In operation, a substantially rigid, hard plastic trimming guard cage 490 is installed onto head 501 of mustache shaving device 500 by sliding the trimming guard cage 490 onto the head. The trimming guard cage 490 can be slidably inserted into any one set of the grooves 508, 509 of the head 501. Each groove set 508,509 positions the lower portion 580, and more particularly the lowermost portion 411 of trimming guard cage 490 a specified distance away from the sharpened edge 17 of blade 16 when the wedges 497 and 498 of trimming accessory 490 are engaged therein. For example, if the user wishes to have a shorter mustache (i.e., trim away more of the existing mustache hair), the user could slide the structure 490 onto the topmost or A groove set (508A and 509A) furthest away from blade 0 edge 17. In this position, the lowermost portion of the trimming guard cage 490 is preferably in the range of 2 mm to 3 mm from the blade. If the user desires a longer mustache, this may be achieved by slidably removing the trimming accessory 490 from the topmost groove set and sliding the structure 490 onto a lower groove set, i.e., the B set (508B, 509B) or the C set (508C, 509C) or the D set (508D, 509D). Thus, the user can position the lowermost portion 411 of the structure 490 closer to or further from the sharpened edge 17 of blade 16, as desired.

In an alternative embodiment, the structure 490 can be made of a more flexible plastic material, such as thin polystyrene or polypropylene, to make the legs 492 and 493 more flexible. This allows the user to push-click the structure 490 over the spacers 512 and 513 and then push-click over each corresponding groove set 508 and 509 until the desired cutting height is achieved. Similarly, by firmly grasping the structure 490 and pulling downwardly, the user can pull-click the structure so the lowermost portion 411 is adjusted further away from the edge 17 of blade 16 in incremental steps. Further, guard 490 may also be tilted laterally to allow the user's mustache hair to be trimmed to any length in between the push-click settings. Thus, trimming guard 490 is well suited to further assist the user in trimming his mustache to any desired length required by the user's mustache style using my shaving devices. In addition, If left on the head portion of the shaving device, guard 490 acts as a safety cover for the razor sharp edge of the shaving device when the device is not in use. If desired, the front end of chamber 465 in FIGS. 35A–35B and of chamber 495 in FIGS. 36A–36B may be closed, at least at the bottom thereof, to further restrict access to the front corner of the blade 16.

FIGS. 37A–37C show a combined cover guard and trimming accessory 530 of the present invention designed to fit on the head portion 11 of my mustache shaving devices 10 having any one of the aforementioned grip tab portions 12. Trimming guard or cage 530 is symmetrical about its longitudinal vertical plane. Cage 530 is designed to enable mustache hair to be trimmed like guard cage 490, but is designed so that blade edge 17 cannot contact or be inadvertently dulled by the fingers.

FIG. 37A shows that the accessory guard structure 530 has an elongated generally hollow body with an elongated chamber 535. An elongated groove 536 is provided in chamber 537 for receiving the lower portion of blade 16. A series of wedge-like slots 534 are provided in the lower half of structure 530, thus defining comb-like fingers 535 through which mustache hair may pass and be trimmed by razor edge 17 of blade 16 when trimming accessory 530 is in use. As with the guard cages described above, the width and number of slots and fingers 534 and 535 may be varied. Further, the length of the fingers 535 can be manufactured to achieve any spacing distance 538 desired. I believe this distance is best kept in the range of 3.5 mm to 8 mm. Structure 530 slidingly engages the cutter portion 11 of the shaving device 10 resting on lower face 540 of upper portion 530. Sides 542 and 543 of structure 530 frictionally contact corresponding left and right sides 503 and 504 of cutter portion 11. As shown in FIG. 37C, structure 530 may be symmetrical about its elongated vertical plane. Alternatively, it may be made asymmetrically (not shown) as in the FIG. 35B cage so that different cutting heights may more easily be achieved.

FIGS. 38A–38B show a one-piece plastic foldable carrying case of the present invention especially designed for transporting and storing any one of my mustache shaving devices. Case 600 has two symmetrical halves 602 and 604 attached by a flexible ribbon 606 of thinner plastic material, which forms a living hinge that flexes to allow the halves to close together to form an enclosed hollow shell which encapsulates pocket 611. Pocket 611 is slightly larger than and is shaped to snugly receive a standard shaving device 10. If desired, pocket 611 may be provided with an adjoining deeper and wider pocket area 608 to accommodate an accessory such as a cage guard or cover installed on the shaving device 10 that is also to be stored. Shell 602 has registration pins 612P while the corresponding shell 604 has registration holes 612H for receiving pins 612P. FIG. 38B shows a side view of the case 600 in its open position illustrating the symmetry between 602 and 604 attached by living hinge 606. These Figures help further illustrate the case 600 is also inexpensive to manufacture.

In operation, the user inserts the shaving device (not shown) into the pocket 611, or if an accessory 560 is used (also not shown), it will be inserted first on the shaving device 10 and then both pieces inserted into the shell 602 or 604 to lay in respective half pocket 608 or 610. The user then bends hinge 606 so that symmetrical halves 602 and 604 come together to mate pins 612P and mating holes 612H and close the unit. FIG. 38C shows that, when closed, the unit is in a compact carrying case that is both easy to handle.

FIG. 39 is another form of a carrying case 622 housing a typical shaving device 10. As shown in FIG. 39B, carrying case 622 is formed from a pre-cut shaped thin-walled sheet of flexible material, preferably a flexible plastic such as polyvinyl chloride or polyethylene. The preformed sheet is folded in half along line 634 and sewn or bonded (such as by heat sealing or adhesive) along the outer perimeter sections 636 and 638 so as to form a pocket 614 to receive a shaving device 10. Snap structure 624 has a male portion 632 and a female portion 633 permanently attached to their respective half-sheets which snappingly engage together, thus closing off a portion of pocket 614, trapping shaving device 10 within pocket 614. As shown in FIG. 39C, when the male portion 632 is inserted into female portion 633 of this repeatedly re-usable snap lock, the opening of pocket 614 is effectively about the size of the hand grip portion 12 and the cutter portion 11 cannot be removed until the snap 624 is opened again. An advantage of this type of a carrying case is that the user can grab the rear portion 640 of the end grip tab 12, undo snap 624, and proceed to remove the cutter shaving device 10. This type of design is both easy and cost effective to manufacture and accommodates both the shaving device by itself and the shaving device with an accessory attached to its blade-carrying head portion.

FIG. 40A–40D illustrate a combined storage, transport and display case and scheme for efficiently and safely packaging multiple identical mustache shaving devices of the present invention, along with an accessory. Case 700 presents one of the devices in a horizontal position where it can be easily seen by a prospective purchaser of this display kit. Case 700 includes a vacuum-formed light-weight thin base 701 of substantially rectangular configuration with rounded corners. Base 701 has a lower external portion 702 and an upper external portion 703 separated by and defining a horizontal external shoulder 704. This style of case is mostly hollow and can be made out of very thin sheet of plastic material such as polypropylene or polyethylene. Further, packaging case 700 includes a complementary lid 705 conforming to the shape of the top exterior portion 703 of base 701, so that its lower lip 706 will rest upon shoulder 704, thus forming a complete enclosure. Lid 705 is preferably vacuum-formed and made out of any suitable transparent plastic material such as a very thin acrylic or PET sheet.

Base 701 is formed with four cavities 714 conforming to the overall shape and size of a prototypical shaving device 10, as shown best in FIGS. 40C and 40D. Case 701 has one shallower cavity 716 formed in the inner flat top surface 709 of case 701. Each cavity 714 is a thin, narrow elongated pocket formed parallel the transverse or minor axis of case 700. Each cavity 714 is just slightly deeper than the lower half of a typical shaving device 10, and is just slightly wider than and conforms to varying width of a typical shaving device 10. As shown in side view in FIGS. 40C and FIGS. 40D, the cavity 714 has the same overall shape as the exterior of a typical shaving device 10, thereby allowing the device 10 to be inserted while in a vertical orientation into the elongated slot 714. Recess 718 is provided in each of the elongated slots 714 so the user can grab a particular shaving device 10 and remove it from the case 700. Recesses 718 may be in the form of a truncated hemisphere or any other suitable shape into which opposed fingertips of a user may be placed in order to easily grip and pull out the device 10 from its slot 714.

In order to more effectively package the mustache shaving devices 10, the slots 714 and recessed holes 718 are preferably arranged in an alternating pattern as shown in FIG. 40A. Thus, the shaving devices 10 are inserted in alternating fashion, one positioned with the grip-tab portion 12 nearest in one side, the adjacent shaving device flipped around so the grip-tab portion 12 is rotated 180 degrees in the package, and is nearest the opposite side.

Cavity 716 is a larger shallower pocket designed to fully receive a typical shaving device 10 when the device is laid-down in a horizontal orientation as shown in FIG. 40A. Recess 720 in cavity 716 may be a truncated hemisphere, and is preferably included in the pocket 716 to provide the user with fingertip access to the shaving device, so it is easy to pick up. As shown in FIG. 40B, when the lid 705 is placed on base portion 701, the overall package is modular and forms a complete sales, transport and user storage unit for multiple shaving devices and one accessory or cover which fits over the head portion 11 of the shaving device 10. By making the base 701 and lid 705 larger, shaving devices 10 or accessories 530 or other types of covers or accessories additional accessories can be added to the case 700 as desired.

The base 701 and lid 705 of this type of enclosure or case 700 may be mass-produced using conventional vacuum forming techniques. Those in the art will appreciate that the design of my case 700 is thus very practical for my small shaving devices and one or more of their accessories, because it provides a modular way to package several of the inexpensive products in an efficient manner, and because cavity 716 is large enough to accommodate both a mustache shaver and a cover or a head-mounted accessory such as guard cage 530. The packaging arrangement of FIGS. 40A–40D thereby allows the user to only purchase one cover or guard cage as part of the package of shaving devices within the case, and he will have it to use with subsequent replacement mustache shaving devices provided in the vertical recesses 714.

Epilogue

The term "razor-sharp blade" or razor blade strip" as used herein, including in the claims, encompasses any elongated blade of appropriate size having a suitably sharpened edge, no matter how constructed. Thus, this term covers blade strips made of a single piece of metal or other sharpened or sharpenable material. It also covers razor blade strips made by bonding a thin gauge strip of metal to a more rigid piece of metal, by laser spot welding or any other technique, as is illustrated in FIG. 16D.

Those skilled in the field will appreciate that the foregoing illustrated and discussed embodiments of the mustache shaving devices of the present invention are subject to modification and change without departing from the scope of the invention as recited in the claims below. Needless to say, the overall size, proportion, materials, weight and clearances of the various components used in the razor-holding portions, the fingertip pinch grip tab portions, and connection mechanisms for attaching the blade strip to the body of the mustache shaving devices of the present invention can be varied as needed or desired. A number of other possible modifications have already been described above. Further changes are clearly possible, as will now be discussed first in the following examples.

(1) Different features and aspects of one embodiment may be combined with another embodiment to provide a mustache shaving device or system with the desired features from both. (2) The lubricant strip used in the above description in FIG. 25 may also be built into the razor head structure through impregnation or molding, rather than being a separate strip glued on to the razor's cap. In other words, a solid shaving aid strip may be provided as an integral portion of the cap or other structural member in any form that is substantially immovable. (3) A smoothly finished glide strip or surface which does not dissolve with use may be used in place of a dissolving lubricant strip material. The glide surface can be made of the same plastic material as the rest of the head, but provided with a very smooth micro-finish. Alternatively any suitably smooth or slippery material may be used as a glide strip by being integrally molded, bonded or mechanically fastened to the blade-supporting structure of the mustache shaving device. The glide strip may be made of polytetrafluoroethylene (PTFE), or of molded plastic, or may be coated, using vapor deposition techniques or other suitable methods, so as to form a smooth, slippery, relatively wear-resistant and substantially inert layer. Such a layer could be gold, silver, chrome or any other metal suitable for contact with human skin, or a non-toxic glassy material such as silicon oxide or the like. (4) Any type of conventional or suitable pin or post arrangement, beyond those already disclosed herein, may be utilized to retain the elongated blade strip within the mustache shaving structures of the present invention. (5) Most of my mustache shaving devices disclosed above may be constructed with a detachable, replaceable cartridge-style razor blade-supporting portion, so that fingertip grip portion may be re-used multiple times. (6) The blade strip within a number of my assembled shaving devices of the present may be made to be individually movable and spring-loaded within the channel in the head or cutter end portion by spring-loading them in the manner similar to that shown and/or described in connection with the FIGS. 34A–34E.

Those in the art should appreciate that my mustache shaving devices and accessories, including the trimming cages, can be profitably used for other facial hair shaving applications, such as precision-shaving and trimming of sideburns, short beards and goatees, and even eyebrows. Those in the art should realize also that my shaving devices and accessories claimed below can also be used for selected pet grooming applications.

Thus, it is to be understood that the devices, accessories and cases of the present invention are by no means limited to the particular constructions herein disclosed and/or shown in the drawings. Instead, the present invention also encompasses any modifications or equivalents that are fairly covered by the claims set forth below.

I claim:

1. A small lightweight fingertip control shaving device for enabling a user to edge and shave his own mustache hair, comprising:

an elongated body having an elongated forward cutter end portion and an elongated rear fingertip pinch grip portion rigidly joined to the cutter end portion, the fingertip grip portion having an overall size approximately as large the area between tips of the user's thumb and forefinger when the tips are pressed together;

a generally flat, elongated blade having an elongated razor sharp edge no longer than about an inch and having a substantially straight elongated dull edge section mounted to the cutter end portion, and wherein the overall size of the fingertip pinch grip portion is at least as large as the overall size of the cutter end portion, and the forward head portion has a major centerline and the fingertip pinch grip portion has a major centerline which is offset from the centerline of the cutter end portion in a direction that places the pinch grip portion further away from the sharp edge of the blade.

2. The shaving device of claim 1 wherein the fingertip grip portion has a dominant overall appearance when viewed afar from either side of a distinct easily recognized shape selected from the group of shapes consisting of a circle, an oval, a rectangle, a trapezoid and a half-moon.

3. The shaving device of claim 1, wherein:

the centerline of the fingertip grip portion is substantially parallel to the centerline of the cutter end portion.

4. The shaving device of claim 1 wherein the fingertip pinch grip portion and the cutter end portion are substantially the same size, the elongated body is substantially flat, and the fingergrip grip portion and the cutter end portion are located in substantially the same plane.

5. The shaving device of claim 1, further comprising an intermediate body portion, located between the fingertip pinch grip portion and the cutter end portion, which rigidly interconnects the grip portion and cutter end portion and spaces the pinch grip portion and cutter end portion away from one another.

6. The shaving device of claim 5, wherein:

the fingertip pinch grip portion and the cutter end portion each have a major centerline, which centerlines are located in two distinctly different planes, and the intermediate body portion includes a rigid section which extends transversely between the fingertip pinch grip portion and the cutter end portion, such that the fingertip pinch grip portion is laterally offset from the major axis of the cutter end portion.

7. The shaving device of claim 1 wherein:

the cutter end portion has an upper section located above the blade and a lower section located adjacent to an elongated part of the blade, with the upper section being thicker than the lower section, whereby the overall cutter end portion tapers downwardly toward the razor sharp edge of the blade.

8. The shaving device of claim 1 wherein:

the cutter end portion has a forward end section and a rearward end section and a plurality of elongated side sections extending between the end sections, with a part of each side section defining a notched region arranged to expose the sharp edge of the blade between the front end section and a rearward end section of the cutter end portion.

9. The shaving device of claim 1 further having an elongated channel forming an opening in the cutter end portion for receiving the elongated dull edge section of the blade, the channel and the fingertip grip portion being located generally within a common plane, the blade extending into and supported at least in part by the channel in the cutter end portion; and wherein the blade is arranged within the channel such that the sharp edge of the blade extends beyond the channel and is substantially exposed.

10. The shaving device of claim 1 further having gripping means on the fingertip grip portion for enhancing the user's pinch grip on the device.

11. The shaving device of claim 10 wherein the enhanced gripping means is selected from the group consisting of raised ridge surface portions, dish-shaped surface portions, knurled surface portions, contoured three-dimensional surface portions, and dimpled surface portions.

12. The shaving device of claim 1, wherein:

the fingertip grip portion and the cutter end portion are integrally formed together and made substantially from the same material.

13. The shaving device of claim 1, which is a mechanically assembled structure and wherein:

the body of the device includes first and second elongated sections of molded material, the first and second sections each having a forward half-portion forming about one-half of the forward cutter end portion and a rear half-portion forming about one-half of the rear fingertip grip portion, with the first and second sections being interconnected together such that they help support and hold the blade in rigidly place.

14. The shaving device of claim 13 wherein, the first and second sections are preformed with complementary mating portions, with the mating portions of the first section being configured to interlock together in close juxtaposed relation with corresponding mating portions of the second section upon assembly of the device.

15. The shaving device of claim 14 wherein the first and second sections are substantially identical.

16. The shaving device of claim 15 wherein:

the blade has at least a plurality of holes therein for receiving registration pins;

the first and second sections each include an internal pocket area for receiving the dull edge section of the blade, and at least one registration pin in the pocket area which is positioned to project through a corresponding one of the registration hole in the blade.

17. The shaving device of claim 1 wherein:

at least the cutter end portion is an assembled structure which includes a base portion and a cover portion, the base portion and cover portion being arranged to form an elongated channel substantially therebetween for receiving at last a part of the dull edge section of the blade.

18. The shaving device of claim 1 wherein:

the fingertip grip portion is integrally formed with the cutter end portion in a common plane, and the fingertip grip portion has a centerline that is substantially perpendicular to the sharpened edge of the blade.

19. A shaving device as in claim 1, further including a removable, elongated cover sized to closely fit over and frictionally hold upon the cutter end portion for covering at least the elongated sharp edge of the blade during non-use thereof, so that the user may manually apply and remove the cover as desired.

20. A shaving device as in claim 1, wherein the sharp edge of the blade is substantially entirely exposed.

21. The shaving device of claim 1 wherein at least one of the elongated sides of the cutter end section near the blade has a surface portion extending away from the sharp edge section of the blade at an acute angle, the surface portion being arranged to form a glide bar for guiding the blade at a predetermined cutting angle along the user's skin.

22. The shaving device of claim 21 wherein the glide bar includes therein an emollient for skin-conditioning and lubricant therein for reducing frictional contact with the skin.

23. A small lightweight fingertip control shaving device for enabling a user thereof to manually edge and shave the periphery of his own mustache, comprising:

an elongated flat body no more than about two inches long having a forward cutter end portion provided with a planar channel and a rear fingertip pinch grip tab portion rigidly connected to the cutter end portion, the cutter end portion and the fingertip grip tab portion being approximately the same size;

a generally flat, elongated blade having a razor sharp edge no more than one inch long, the blade being mounted to the cutter end portion in the channel such that the razor sharp edge is at least substantially exposed, and extends outwardly from the channel and is in the same plane therewith.

24. The shaving device of claim 23 wherein:

the cutter end portion has a forward end section and a rear end section, each extending longitudinally beyond the sharp edge of the blade, with an elongated channel having an elongated opening being formed in the cutter end portion between the end sections;

the channel and its opening extends along substantially the same plane as the fingertip grip portion; and the blade is located at least partially in and supported by the elongated channel.

25. The shaving device of claim 23 wherein the fingertip grip portion and the cutter end portion have substantially identical side profiles.

26. The shaving device of claim 23 wherein the pinch grip tab portion and the cutter end portion have a centerlines which are substantially parallel to one another, with the centerline of the pinch grip portion being offset from the centerline of the cutter end portion in a direction away from the sharp edge of the blade.

27. The shaving device of claim 23 wherein the elongated body has a major centerline substantially dividing the device in half, with the pinch grip portion and the cutter end portion being arranged symmetrically about the major centerline.

28. The shaving device of claim 27 wherein the side profiles of pinch grip portion and the cutter end portion of the elongated body are arranged about the centerline such that each forms a mirror image of one another.

29. The shaving device of claim 23 wherein the pinch grip portion includes a plurality of side surfaces of varying topography for assisting the user in maintaining a firm grip the pinch grip portion.

30. The shaving device of claim 29 wherein the side surfaces of varying topography each include a grip-enhancing texture selected from the group consisting of dimples, ridges and knurls.

31. The shaving device of claim 29 wherein the surfaces of varying topography each include a grip-enhancing non-planar surface selected from the group of surfaces consisting of shallow depressions and finger-constraining rises.

32. The shaving device of claim 23 wherein the blade is formed as a flat strip of metal and has a substantially straight elongated razor sharp edge section.

33. The shaving device of claim 32 wherein the blade strip further includes at least one sharpened curved edge section.

34. The shaving device of claim 23 wherein the blade has at least one blunted section adjacent to the razor sharp section, whereby a user is able to locate the razor sharp section against his skin more precisely by touching the blunted section to his skin and thereafter applying pressure on the razor sharp edge to shave his mustache hair.

35. The shaving device of claim 23 wherein a blunt section is provided on each end of the razor sharp edge.

36. The shaving device of claim 35 wherein the blunt sections are selected from the group of blunt edges consisting of rounded blade edge sections, blunted angled corner sections, and straight dull blade sections.

37. A shaving device as in claim 36, wherein the blunt section of at least one end of the razor sharp edge includes a side edge adjacent to the straight elongated sharp edge, with the side edge being at an angle relative to the sharp edge, thus defining a corner area of the blade edge, with the edge of the blade in the corner area being less sharp than the straight sharp edge of the blade.

38. A shaving device as defined in claim 23, wherein the cutter end portion includes a main body section having a channel therein for receiving the blade and end body sections located on opposite longitudinal ends of the main body section, which end body sections extend outwardly from the main body section to substantially envelop the forward and rear ends of the blade, the outermost surfaces of the end body sections being blunted in comparison to the blade sharp edge, whereby the forward and rear ends of the blade sharp edge are effectively guarded by the end body sections.

39. A device as defined in claim 23, further including a removable, elongated accessory sized to closely fit over and frictionally hold up the cutter end portion of the device, the accessory being selected from the group of accessories consisting of blade covers, blade sleeves, steadyrests and hair-trimming guard cages.

40. A shaving device as defined in claim 39, further including a thin-walled substantially flexible universal cover sized to fit over both the shaving device and the selected accessory, and universal cover including a repeatedly releasable and refastenable closure structure strategically placed on the cover to help ensure the device and selected accessory remain substantially within the cover when placed inside thereof, by fastening the closure.

41. A shaving device as defined in claim 23, further including a substantially rigid container having an internal chamber and configured for receiving and protecting the shaving device and a selected accessory, the container being formed from at least two large body parts arranged to form the chamber, and manually-operable mechanical fastening means for holding the container closed when desired, the fastening means being repeatedly engageable and releasable.

42. A shaving device as in claim 23, further including a display and storage case formed at least in part of molded plastic forming a packaging structure having a plurality of substantially open chambers formed therein for receiving a plurality of the shaving devices substantially identical to said shaving device.

43. A shaving device as defined in claim 39, wherein the accessory is an elongated cover formed of plastic material of a length and width to snugly fit over and envelop the elongated exposed sharp edge of the blade and adjacent areas of the cutter end portion, the cover being frictionally engaged upon the frontal end portion and being manually removable and replaceable when desired.

44. A shaving device as defined in claim 39, wherein the accessory is a steadyrest having an upper portion of a length and width to snugly fit over spaced apart areas of the cutter end portion, and a lower portion with a outboard edge extending laterally outwardly from the upper portion and configured, when the steadyrest is installed upon the cutter end portion, such the outboard edge is parallel to the straight sharp edge of the blade, the steadyrest being manually removable from the cutter end portion and replaceable when desired.

45. The shaving device of claim 39 wherein the accessory is a hair-trimming cage having an upper section and a lower section, the upper section being of a length and width to snugly and removable engage a corresponding upper section of the cutter end portion, and the lower section having a plurality of teeth spaced from one another and enveloping the sharpened edge of the blade, the lower section being provided with first and second elongated glide surfaces located on opposite sides of the blade, the first and second sides each configured to provide its own predetermined nominal clearance distance between the razor sharp edge of the blade and a user's skin, whereby the user can precisely cut his mustache hair to a preset length when using the hair-trimming cage installed upon the cutter end portion as a guide during mustache trimming.

46. The shaving device of claim 45 wherein the teeth on opposite side surfaces are integrally formed and interconnected.

47. A shaving device as in claim 23, wherein the cutter end portion includes a main body section having an elongated channel formed therein for receiving the blade, and includes a plurality of fingers separated by notches which fingers extend laterally outwardly from the main body section in a direction toward the exposed sharp edge of the blade.

48. A shaving device as in claim 23, wherein:

the cutter end portion includes a two-piece structure including a first section having a pocket formed therein for receiving a portion of the blade, and a second section which is arranged to be matingly coupled with the first section, thereby end the blade securely within the pocket; and the blade is a metal strip having at least one razor sharp edge which constitutes the straight elongated sharp edge of the blade; and the blade is assembled into the cutter end portion by inserting the blade into the pocket.

49. A shaving device as in claim 23, wherein the blade is a separate metal blade having only one razor sharp edge, and the blade has an unsharpened edge which extends generally parallel to the razor sharp edge.

50. A mustache cutting device as in claim 23, wherein the centerline of the forward end portion and the centerline of the rear grip portion are substantially parallel to one another.

51. A small lightweight fingertip control mustache shaving device for enabling a user thereof to manually edge and shave the periphery of his own mustache, comprising:

an elongated body no more than about two inches long having a forward elongated head portion and a rear fingertip grip portion rigidly joined to the head portion, the fingertip grip portion being sized to the free tips of a user's thumb and forefinger, and the head portion including an elongated chamber for receiving a removable razor blade cartridge;

a razor blade cartridge of predetermined configuration corresponding to the elongated chamber and including a blade support structure and generally flat, elongated blade strip attached thereto, the blade strip being provided with a razor sharp edge no more one inch long, the blade strip being mounted to the blade support structure, and arranged such that, when the razor blade cartridge is fully inserted in the elongated chamber the razor sharp edge is at least substantially exposed and extends laterally outwardly from the head portion, and wherein the fingertip grip portion is offset in a direction away from the razor sharp edge of the blade strip.

52. The shaving device of claim 50 wherein the blade support structure is an assembled structure having a blade platform member and a blade cap member, each having interlocking mating surface portions arranged to captivate a portion of blade strip therebetween.

53. A shaving device as defined in claim 51, further including a removable, elongated accessory sized to closely fit over and frictionally hold upon the head portion, the accessory being selected from the group of accessories consisting of blade covers, steadyrests, and hair-trimming cages.

54. The shaving device of claim 51 wherein:

the elongated body is formed of a plurality of half-body sections which are joined together, and form the chamber therebetween.

55. A small lightweight fingertip control razor blade shaving system for precision shaving and trimming of a mustache or other facial hair, the system comprising:

a small lightweight shaving device having an elongated body no more than about two inches long provided with a forward elongated head portion and a rear fingertip grip portion joined to the head portion, the fingertip grip portion being sized to be grasped by the free tips of a user's thumb and forefinger, and the head portion including an elongated chamber for receiving a portion of a razor blade strip; and a razor blade strip of predetermined configuration having a razor sharp edge no more than one inch long that is at least substantially exposed and is partially encased by and extends laterally outwardly from the head portion; and an accessory structure of predetermined configuration having a chamber therein, the accessory being arranged to be removably placed over at least that part of the head portion of the shaving device in which the blade strip is at least partially encased, the accessory structure having a cage portion which is arranged to substantially surround and guard the razor sharp edge of the blade strip, the cage portion having a plurality of finger sections, each having a substantially uniform exterior surface, with openings being provided between adjacent finger sections, which openings are each sufficiently large to enable facial hair that is to be trimmed to protrude therethrough into the path of the razor edge when a portion of the exterior surfaces of the finger sections are stroked over a user's facial skin underlying that hair, whereby the razor sharp edge cuts that hair to be trimmed to a length which is predetermined and at least as long as the spacing provided between exterior surface portion contacting the user's skin and the razor edge.

56. The shaving device of claim 55 wherein:

the elongated body of the device includes first and second sections of preformed material, the first and second sections each having a forward half-portion forming about one-half of the forward head portion and a rear half-portion forming about one-half of the rear fingertip grip portion, with the first and second sections being interconnectable together such that they define the chamber and help support and hold the blade strip; and the accessory structure has two sets of finger sections spaced from one another, and the chamber has an elongated groove area through which a portion of the blade strip projects, and the location of the structure relative to the head portion is adjustable such that the length to which the hair is to be trimmed may be changed.

* * * * *

UNITED STATES PATENT AND TRADEMARK OFFICE

CERTIFICATE OF CORRECTION

PATENT NO. : 5,673,711

DATED : October 7, 1997

INVENTOR(S) : E. Andrews

It is certified that error appears in the above-identified patent and that said Letters Patent is hereby corrected as shown below:

Title Page, column 1, Title, line 2, replace "DEVICE" with --DEVICES--.

Title Page, column 1, Cross Ref., replace "30,949" with --319,149--.

Title Page, column 2, line 12, prior art, replace "802750" with --802752--.

Column 2, line 33, insert after mustache hair --and--.

Column 4, line 62, after However add --,--.

Column 6, line 64, delete 2nd occurrence of "a".

Column 7, line 11, replace "FIGS." with --FIG.--.

Column 7, line 67, after edge add --of--.

Column 8, line 22, replace "an" with --a--.

Column 8, line 30, after sharpened insert --blade edge--.

Column 8, line 39, replace "dearly" with --clearly--.

Column 8, line 50, replace "FIG." with --FIGS.--.

Column 9, line 29, after slightly add --enlarged--.

Column 9, line 58, replace "FIG." with --FIGS.

Column 13, line 14, replace "end" with --and--.

Column 13, line 19, replace "dosed" with --closed--.

Column 14, line 54, after 16D insert " , ".

Column 15, line 2, after "may" add --be--.

UNITED STATES PATENT AND TRADEMARK OFFICE

CERTIFICATE OF CORRECTION

PATENT NO. : 5,673,711
DATED : October 7, 1997
INVENTOR(S) : E. Andrews

It is certified that error appears in the above-identified patent and that said Letters Patent is hereby corrected as shown below:

Column 16, line 13, replace "2A" with --20A--.

Column 16, line 34, delete "such".

Column 16, line 35, replace "FIG." with --FIGS.--.

Column 16, line 48, replace "FIG." with "FIGS."

Column 16, line 59, replace "FIG." with "FIGS.".

Column 17, line 7, replace "165" with --188--.

Column 19, line 17, replace "29B" with --27B--.

Column 19, line 35, replace "of device" with --device of--.

Column 19, line 58, after "27B" add -- , --.

Column 20, line 23, replace "is" with --to be--.

Column 20, line 27, after "even" add --be--.

Column 20, lines 31-32, replace 2nd occurrence of "be" with --by--.

Column 20, line 47, replace "FIG." with --FIGS.--.

Column 20, line 50, after "27B" add -- , --.

Column 21, line 28, replace "FIG." with --FIGS.--

Column 21, lines 40-41, replace "have been strip" with --of pinch grip--.

Column 21, line 44, replace "FIG." with --FIGS.--

Column 21, line 56, replace "FIG." with --FIGS.--

UNITED STATES PATENT AND TRADEMARK OFFICE

CERTIFICATE OF CORRECTION

PATENT NO. : 5,673,711
DATED : October 7, 1997
INVENTOR(S) : E. Andrews

It is certified that error appears in the above-identified patent and that said Letters Patent is hereby corrected as shown below:

Column 21, line 64, replace "haft" with --half--.

Column 21, line 65, after "375" add --is--.

Column 22, line 14, delete "a".

Column 22, line 15, delete space before --D--.

Column 23, line 61, before guard add --of--.

Column 24, line 9, replace "it" with --its--.

Column 24, line 28, delete space before --P--.

Column 24, line 36, after "points" delete "in between".

Column 25, line 34, after "blade" delete "0".

Column 25, line 61, replace "If" with --if--.

Column 26, line 60, replace "FIG. 39 is" with --FIGS. 39A-39B illustrate--.

Column 27, line 17, replace "FIG. 40A" with --FIGS. 40A--.

Column 27, line 45, replace in both occurrences "FIGS." with --FIG.--.

Column 28, line 10, delete second occurrence of "or accessories".

Column 28, line 28, before second occurrence of "razor" add -- " --.

Column 29, line 16, after "present" add --invention--.

Column 29, line 20, delete "the" before FIGS.

UNITED STATES PATENT AND TRADEMARK OFFICE

CERTIFICATE OF CORRECTION

PATENT NO. : 5,673,711
DATED : October 7, 1997
INVENTOR(S) : E. Andrews

It is certified that error appears in the above-identified patent and that said Letters Patent is hereby corrected as shown below:

Column 29, line 43, claim 1, after "large" add --as--.

Column 30, line 2, claim 4, replace "fingergrip" with --fingertip--.

Column 30, line 65, claim 13, replace "in rigidly" with --rigidly in--.

Column 32, line 7, claim 26, delete "a".

Column 32, line 22, claim 29, after "grip" add --on--.

Column 33, line 39, claim 44, after "such" add --that--.

Column 33, line 46, claim 45, replace "removable" with --removably--.

Column 34, line 35, claim 51, after "more" add --than--.

Signed and Sealed this

Twenty-eighth Day of July, 1998

*Attest:*

*Attesting Officer*

BRUCE LEHMAN

*Commissioner of Patents and Trademarks*